US010977920B2

(12) United States Patent
Nelson et al.

(10) Patent No.: US 10,977,920 B2
(45) Date of Patent: Apr. 13, 2021

(54) FIRE SAFETY SYSTEM WITH INTEGRATED LIGHTING DEVICES

(71) Applicants: Paul C. Nelson, Milwaukee, WI (US); Ivo Rutten, Milwaukee, WI (US)

(72) Inventors: Paul C. Nelson, Milwaukee, WI (US); Ivo Rutten, Milwaukee, WI (US)

(73) Assignees: Johnson Controls Technology Company, Auburn Hills, MI (US); Signify-Holding B.V., Eindhoven (NL)

( * ) Notice: Subject to any disclaimer, the term of this patent is extended or adjusted under 35 U.S.C. 154(b) by 0 days.

(21) Appl. No.: 16/449,148

(22) Filed: Jun. 21, 2019

(65) Prior Publication Data

US 2020/0402381 A1 Dec. 24, 2020

(51) Int. Cl.
*G08B 17/10* (2006.01)
*G08B 7/06* (2006.01)
(Continued)

(52) U.S. Cl.
CPC ..... *G08B 17/10* (2013.01); *F21V 15/01* (2013.01); *F21V 23/003* (2013.01);
(Continued)

(58) Field of Classification Search
CPC .. F21V 33/00; F21V 33/0064; F21V 33/0076; G08B 17/00; G08B 17/10; G08B 17/11; G08B 17/113; G08B 17/117; G08B 29/00; G08B 29/12; G08B 29/126; G08B 29/14; G08B 29/145
See application file for complete search history.

(56) References Cited

U.S. PATENT DOCUMENTS 4,255,746 A 3/1981 Johnson et al.
4,717,910 A * 1/1988 Scripps ..... F21V 33/0076 340/586

(Continued)

FOREIGN PATENT DOCUMENTS

CN 206861398 U 1/2018
EP 3 134 886 A1 3/2017

OTHER PUBLICATIONS

U.S. Appl. No. 16/530,976, filed Aug. 2, 2019, Johnson Controls Technology Company.

(Continued)

*Primary Examiner* — Andrew W Bee
(74) *Attorney, Agent, or Firm* — Foley & Lardner LLP

(57) ABSTRACT

A device for illumination and fire safety in a room includes a housing, one or more light emitting devices, one or more fire safety components, and a controller. The one or more light emitting devices are coupled to the housing and configured to provide ambient lighting for the room during a normal mode of operation. The one or more fire safety components are coupled to the housing and configured to notify occupants of the room of a fire during an alarm mode of operation. The controller is configured to transition from the normal mode of operation into the alarm mode of operation in response to detecting the fire. The device may include facilities for remote self-testing which may include one or more of a light detector, a sound detector, and a smoke emission system. The device may perform the self-test in a test mode.

20 Claims, 12 Drawing Sheets

(51) Int. Cl.

| | |
|---|---|
| ***F21V 33/00*** | (2006.01) |
| ***F21V 15/01*** | (2006.01) |
| ***F21V 23/00*** | (2015.01) |
| ***G08B 29/14*** | (2006.01) |

(52) U.S. Cl.
CPC ..... *F21V 33/0076* (2013.01); *G08B 7/066* (2013.01); *G08B 29/145* (2013.01)

(56) References Cited

U.S. PATENT DOCUMENTS

| | | | | |
|---|---|---|---|---|
| 4,896,145 | A | 1/1990 | Lewkowicz | |
| 7,400,226 | B2 | 7/2008 | Barrieau et al. | |
| 8,376,582 | B2 | 2/2013 | Catone et al. | |
| 8,414,155 | B2 | 4/2013 | Catone et al. | |
| 9,711,016 | B2 | 7/2017 | Spina | |
| 10,441,832 | B1 | 10/2019 | Trivelpiece et al. | |
| 2008/0198583 | A1 | 8/2008 | McMillen | |
| 2009/0072970 | A1 | 3/2009 | Barton | |
| 2009/0078065 | A1* | 3/2009 | Rossiter | G08B 29/145 73/865.6 |
| 2009/0196016 | A1 | 8/2009 | Massara et al. | |
| 2010/0033319 | A1* | 2/2010 | Pattok | G08B 7/06 340/538 |
| 2010/0102960 | A1 | 4/2010 | Simon et al. | |
| 2012/0286946 | A1* | 11/2012 | Karl | G08B 29/126 340/516 |
| 2014/0266747 | A1* | 9/2014 | Prendergast | G08B 17/10 340/628 |
| 2014/0340215 | A1* | 11/2014 | Piccolo, III | G08B 29/12 340/514 |
| 2016/0116389 | A1* | 4/2016 | Cooper | G08B 29/183 356/340 |
| 2018/0018866 | A1 | 1/2018 | Carlin et al. | |
| 2018/0082685 | A1* | 3/2018 | Carlin | H05B 47/105 |
| 2018/0293878 | A1* | 10/2018 | Penney | G08B 29/145 |

OTHER PUBLICATIONS

U.S. Appl. No. 16/567,773, filed Sep. 11, 2019, Johnson Controls Technology Company.
International Search Report and Written Opinion on PCT/US2020/038951, dated Nov. 16, 2020, 27 pages.

* cited by examiner

FIRE SAFETY SYSTEM WITH INTEGRATED LIGHTING DEVICES

BACKGROUND

The present disclosure relates generally to building control systems and more particularly to a Fire Detection System (FDS) for a building. A FDS is, in general, a system of devices configured to control, monitor, and manage equipment in or around a building or building area to detect and suppress fires. A FDS can include, for example, a fire alerting system, a fire suppression system, and any other system that is capable of managing building fire safety functions or devices, or any combination thereof.

SUMMARY

One implementation of the present disclosure is a device for illumination and fire safety in a room. The device includes a housing, one or more light emitting devices, one or more fire safety components, and a controller. The one or more light emitting devices are coupled to the housing and configured to provide ambient lighting for the room during a normal mode of operation, according to some embodiments. The one or more fire safety components are coupled to the housing and configured to notify occupants of the room of a fire during an alarm mode of operation, according to some embodiments. The controller is configured to transition from the normal mode of operation into the alarm mode of operation in response to detecting the fire, according to some embodiments.

In some embodiments, the one or more fire safety components include a sound emitting device and the device for illumination and fire safety includes an alert light. In some embodiments, the alert light is one of the one or more light emitting devices configured to provide ambient lighting for the room. In some embodiments, the alert light is a separate alert light. In some embodiments, the controller is configured to operate the sound emitting device and the alert light to provide an aural notification and a visual notification to the occupants of the room during the alarm mode of operation.

In some embodiments, the one or more fire safety components include a smoke detection system configured to detect a presence of smoke or other airborne medium in the room.

In some embodiments, the one or more fire safety components include a smoke emission system. In some embodiments, the controller is configured to operate the smoke emission system to provide a predetermined amount of an airborne test medium to the room and monitor an amount of the airborne test medium present in an air sample detected by the smoke detection system during a test mode of operation. In some embodiments, the housing is configured to conceal the smoke emission system and the smoke detection system from occupants of the room.

Another implementation of the present disclosure is an illumination and fire safety system for a building. In some embodiments, the system includes a fire alarm control panel and an illumination and fire safety device configured to provide the fire alarm control panel with fire detection data. In some embodiments, the illumination and fire safety device includes one or more light emitting devices, one or more fire safety components, a controller, and a housing. In some embodiments, the one or more light emitting devices are configured to provide lighting for a room. In some embodiments, the one or more fire safety components are configured to detect a presence of fire in the room. In some embodiments, the controller is configured to receive fire detection signals from the one or more fire safety components and provide the fire detection data to the fire alarm control panel in response to detecting the presence of fire in the room. In some embodiments, the housing is configured to conceal the one or more fire safety components and the controller from occupants of the room.

In some embodiments, the system includes an alert light configured to produce a visual alert regarding the presence of fire in the room and a sound emitting device configured to produce an aural alert regarding the presence of fire in the room. In some embodiments, the alert light is one of the one or more light emitting devices. In some embodiments, the alert light is a separate alert light.

In some embodiments, the illumination and fire safety device includes a light detector and a sound detector. In some embodiments, the controller is configured to perform an alarm test including activating at least one of the sound emitting device or the alert light, and monitoring input received via at least one of the sound detector or the light detector to determine whether the sound emitting device is producing the aural alert or the alert light is producing the visual alert.

In some embodiments, the one or more fire safety components include a smoke detection system configured to detect a presence of smoke or another airborne medium in the room.

In some embodiments, the smoke detection system includes an air sample delivery system and a sensing chamber. In some embodiments, the air sample delivery system is configured to receive a sample of air from the room and provide the sample of air to the sensing chamber.

In some embodiments, the illumination and fire safety device includes a smoke emission system configured to provide a metered amount of an airborne test medium to the room. In some embodiments, the housing is configured to conceal the smoke emission system from the occupants of the room.

In some embodiments, the controller is configured to perform a smoke detection test including operating the smoke emission system to emit the metered amount of the airborne test medium into the room, and monitoring a presence of the airborne test medium detected by the smoke detection system.

In some embodiments, the one or more light emitting devices are configured to provide egress lighting in an emergency.

Another implementation of the present disclosure is a device for illumination and fire safety in a room of a building. In some embodiments, the device includes one or more light emitting devices, a smoke detection system, a sound emitting device, an alert light, a controller and a housing. In some embodiments, the one or more light emitting devices are configured to provide lighting for the room when operating in a normal mode. In some embodiments, the smoke detection system is configured to detect a presence of smoke in the room. In some embodiments, the sound emitting device is configured to produce an aural alert regarding a presence of fire in the room. In some embodiments, the alert light is configured to produce a visual alert regarding the presence of fire in the room. In some embodiments, the controller is configured to receive smoke detection information from the smoke detection system and operate the aural alert device and the visual alert device to produce the aural alert and the visual alert in response to the presence of fire in the room. In some embodiments, the housing is configured to conceal the smoke detection system and the controller from occupants of the room. In some embodiments, the one or more light emitting devices are configured to illuminate the room to provide visibility for the occupants of the room when a fire is not present in the room.

In some embodiments, the alert light is configured to produce a strobe light for the visual alert, the sound emitting device is configured to produce a fire alarm noise for the aural alert, and the controller is configured to operate the alert light and the sound emitting device to synchronously produce the strobe light and the fire alarm noise.

In some embodiments, the device further includes a smoke emission system configured to provide a metered amount of airborne test medium to the room. In some embodiments, the housing is configured to conceal the smoke emission system from the occupants of the room.

In some embodiments, the controller is configured to perform a smoke detection test including operating the smoke emission system to emit the metered amount of airborne test medium into the room, and monitoring a presence of airborne test medium detected by the smoke detection system.

In some embodiments, the smoke emission system includes a smoke delivery system configured to provide the metered amount of airborne test medium to the room.

In some embodiments, the smoke detection system includes an air sample delivery system and a sensing chamber. In some embodiments, the air sample delivery system is configured to receive a sample of air from the room and provide the sample of air to the sensing chamber.

In some embodiments, the device further includes a light detector and a sound detector. In some embodiments, the controller is configured to perform an alarm test to determine if the sound emitting device is able to produce the aural alert and if the alert light is able to produce the visual alert.

In some embodiments, the alarm test includes operating the alert light to produce the visual alert and monitoring intensity of light measured by the light detector to determine if the alert light is able to produce the visual alert. In some embodiments, the alarm test includes operating the sound emitting device to produce the aural alert and monitoring a sound level of noise in the room measured by the sound detector to determine if the sound emitting device is able to produce the aural alert.

DETAILED DESCRIPTION

Overview

Figure 1:
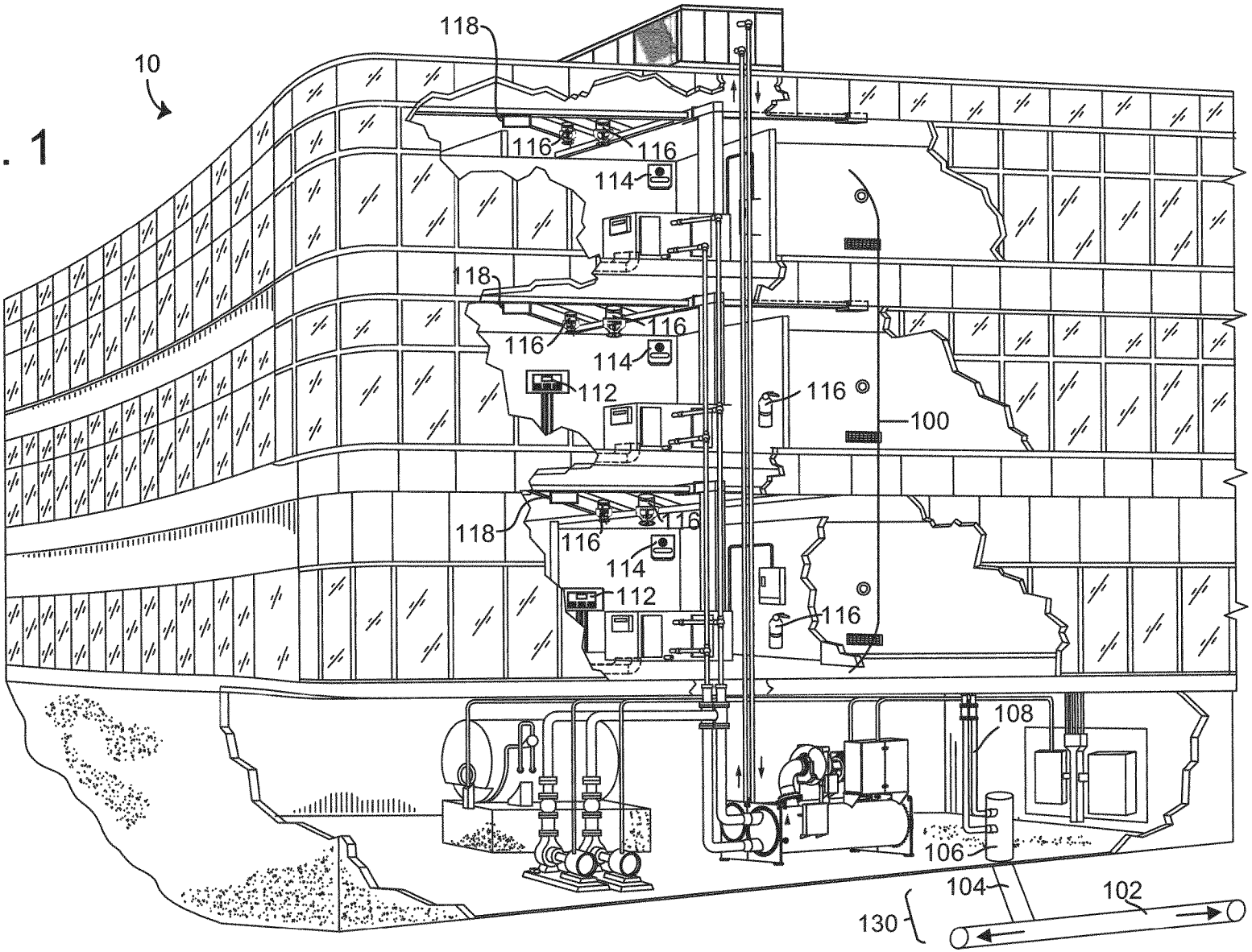
FIG. 1 is a drawing of a building equipped with a building management system (BMS) and a fire system, according to some embodiments.

Referring generally to the FIGURES, a fire system for a building is shown, according to some embodiments. The fire system includes a BMS controller configured to operate HVAC equipment, according to some embodiments. The fire system also includes a fire alarm control panel, according to some embodiments. The fire system includes one or more fire suppression devices configured to provide fire suppressant agent to various rooms of the building, according to some embodiments. The fire suppression devices can be activated by the fire alarm control panel. The fire system also includes fire safety devices, according to some embodiments. The fire safety devices may have the appearance of a luminaire, or a lighting apparatus. The fire safety devices can include light emitting devices to provide ambient lighting to a room. The fire safety devices include a controller, a smoke detection system, a smoke emission system, a light sensor, a sound sensor, an alert light, a sound emitting device, and a temperature sensor. The sound emitting device may be any of a horn, a siren, a speaker, etc., or any other device that can provide an aural notification (e.g., a noise, a sound, etc.) to occupants of the room. The fire safety device includes a housing configured to provide structural support for the light emitting devices and conceal the fire detection system, the smoke emission system, and the controller from occupants of the room. The smoke detection system can include a smoke delivery system configured to receive an air sample from the room and provide the air sample to a sensing chamber. The sensing chamber may be any smoke detection chamber that is configured to measure the presence of fire signatures such as smoke, heat, or carbon monoxide. In some embodiments, the smoke detection system or the smoke detection chamber includes various environmental sensing technologies such as particulate (e.g., PM2.5, PM10, etc.) VOC, or other gasses, or environmental contaminants that are of concern. The smoke detection chamber can be configured to identify the presence of any other particles that indicate presence of a fire in the air sample. The smoke detection system can include an air moving device configured to facilitate providing the air sample to the sensing chamber. The air moving device can be a fan that draws the air sample into the sensing chamber.

The fire safety device can transition between a normal mode of operation, a test mode of operation, and an alarm mode of operation. The controller may receive commands from the fire alarm control panel to transition between the various modes of operation. The controller may provide the fire alarm control panel with any sensory information (e.g., smoke detection information, temperature detection information, light detection information, sound detection information, etc.) collected from the one or more sensors, devices, and systems of the fire safety device. When the fire safety device is in the normal mode of operation, the fire safety device may function as a smoke detector, or a combination of a smoke and a heat detector. The fire alarm control panel can be configured to perform a fire detection process to determine if a fire is present in the room in which the fire safety device is positioned. In some embodiments, the controller of the fire safety device performs the fire detection process to determine if a fire is present in the room. In some embodiments, during the normal mode of operation, the fire safety device functions as a lighting device (e.g., to illuminate the room). The fire safety device can be connected with a lighting system and may be controlled by occupants of the room (e.g., with a light switch).

The fire safety device may transition into the alarm mode of operation in response to determining that a fire is present in the room or in response to receiving a command from the fire alarm control panel. The alarm mode of operation includes providing a visual notification and an aural notification (e.g., a strobe light and a siren noise) to the occupants of the room via the alert light and the sound emitting device.

The fire safety device can transition into the test mode of operation to test the functionality of the smoke detection system, the sound emitting device, and the alert light. The alert light and the sound emitting device may be referred to as a fire alarm system that provides a fire notification to occupants of the room regarding the presence of a fire in the building or in the room. The controller may be configured to perform various predetermined processes to determine if the smoke detection system, the sound emitting device, and the alert light are functioning properly. The controller can report results of the various tests to the fire alarm control panel.

The fire safety device is configured to perform a smoke detection test, according to some embodiments. The smoke emission system may include an actuator or a valve configured to provide a metered amount of test smoke or airborne medium from a smoke container to the room. The airborne test medium can be any particulate matter, liquid, or gas (e.g., smoke, simulated smoke, an aerosol, etc.) for the smoke detection test. The controller can operate the actuator to provide the metered amount of smoke or airborne test medium to the room. The controller may receive sensory feedback from the sensing chamber to determine if smoke is sensed. If the test smoke is detected by the sensing chamber, the controller can determine that the smoke detection system is functioning properly. If the test smoke is not detected by the sensing chamber, the controller may determine that the smoke detection system is not functioning properly. In some embodiments, the smoke detection test is performed in response to the controller receiving a command from the fire alarm control panel to perform the smoke detection test. The controller can be communicably connected with the fire alarm control panel and can provide the fire alarm control panel with results of the smoke detection test. In some embodiments, the controller is configured to provide the fire alarm control panel with the sensory data of the sensing chamber collected/received during the smoke detection test.

The fire safety device is also configured to perform a fire alarm test, according to some embodiments. The fire alarm test may include operating the alert light and the sound emitting device to produce the visual alert and the aural alert. The controller may monitor sensory feedback of the light sensor and the sound sensor to determine if the alert light and the sound emitting device are able to produce the visual and the aural alert. If the controller does not receive expected sensory feedback from the light sensor and the sound sensor during the fire alarm test, the controller may report to the fire alarm control panel that the alert light and/or the sound emitting device are not operating properly. If the controller receives expected values of sensory feedback from the light sensor and the sound sensor (e.g., an expected light intensity and an expected decibel level), the controller may report to the fire alarm control panel that the alert light and the sound emitting device are operating properly.

Advantageously, the fire safety device and the fire system can reduce costs associated with installing, testing, and maintaining multiple fire detection and fire notification devices. The fire safety device can be used to detect fires in the building, as well as to provide fire notifications to occupants of the building. Another advantage is that the fire safety device may have the appearance and functionality of a lighting fixture and can improve the aesthetic appearance of the rooms of the building.

Building Management System

Referring now to FIGS. 1-6, a building management system (BMS) and fire suppression system are shown, according to some embodiments. Referring particularly to FIG. 1, a perspective view of a building 10 is shown, according to some embodiments. Building 10 is served by a BMS, according to some embodiments. A BMS is, in general, a system of devices configured to control, monitor, and manage equipment in or around a building or building area, according to some embodiments. A BMS can include, for example, a fire suppression system, a security system, a lighting system, a fire detection system, any other system that is capable of managing building functions or devices, or any combination thereof.

The BMS that serves building 10 includes a fire system 100 (e.g., a fire detection and/or fire suppression system), according to some embodiments. Fire system 100 can include a plurality of fire safety devices (e.g., alarm initiating devices such as fire detectors and pull stations, sprinklers, fire alarm control panels, fire extinguishers, water systems etc.) configured to provide fire detection, fire suppression, fire notification to building occupants 150, or other services for building 10. Fire system 100 includes water system 130, according to some embodiments. Water system 130 provides water from a city line 102 through a building line 104 to building 10 to suppress fires within one or more rooms/spaces of building 10, according to some embodiments. In some embodiments, a main water line 106 is the dominant piping system that distributes water throughout one or more of the building floors in building 10. The water is distributed to the one or more building floors of building 10 via a piping system 108, according to some embodiments.

Figure 3:
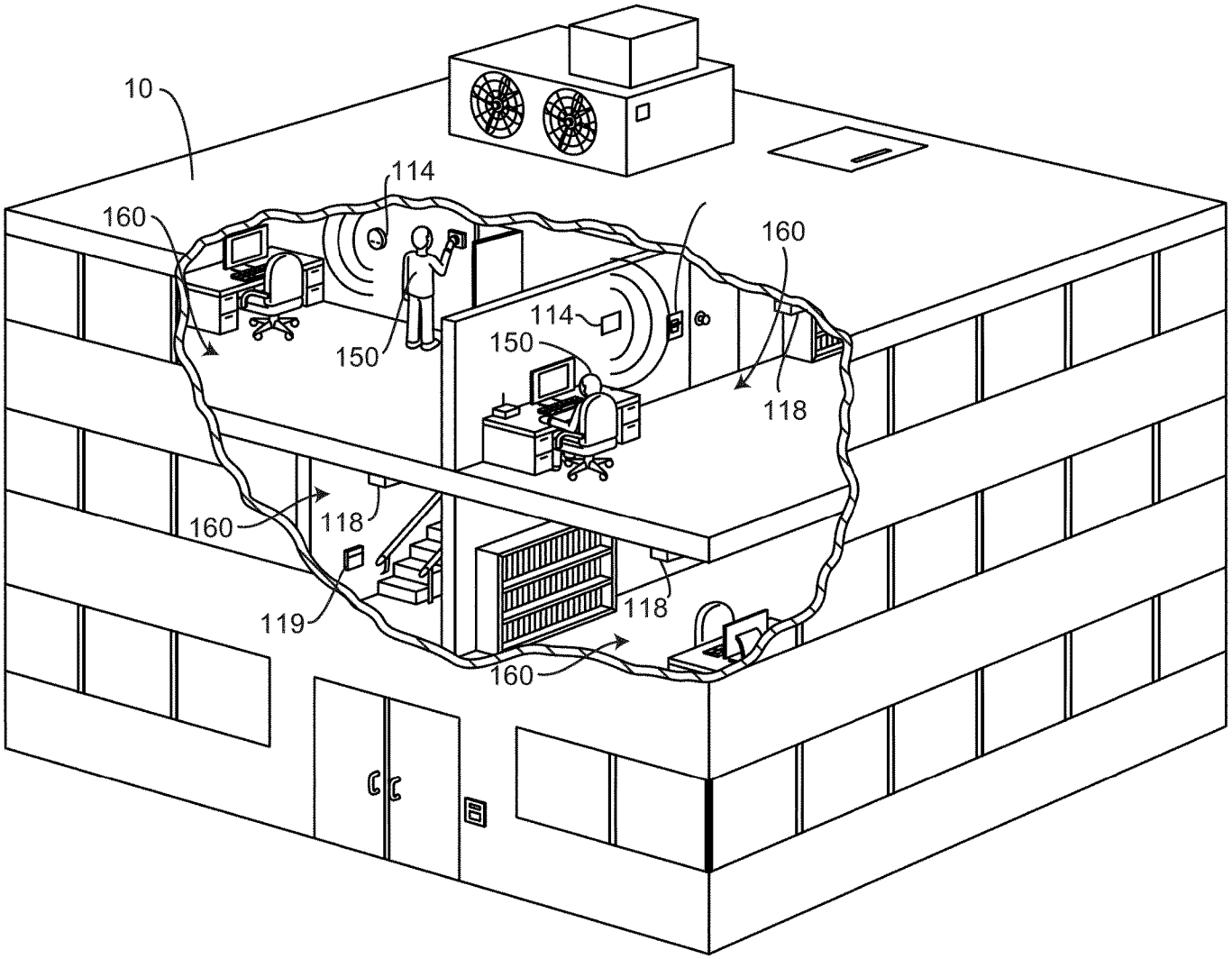
FIG. 3 is a perspective view of the building of FIG. 1, including rooms, occupants, fire notification devices, fire suppression devices, and fire detection devices of the fire system, according to some embodiments.
Figure 4:
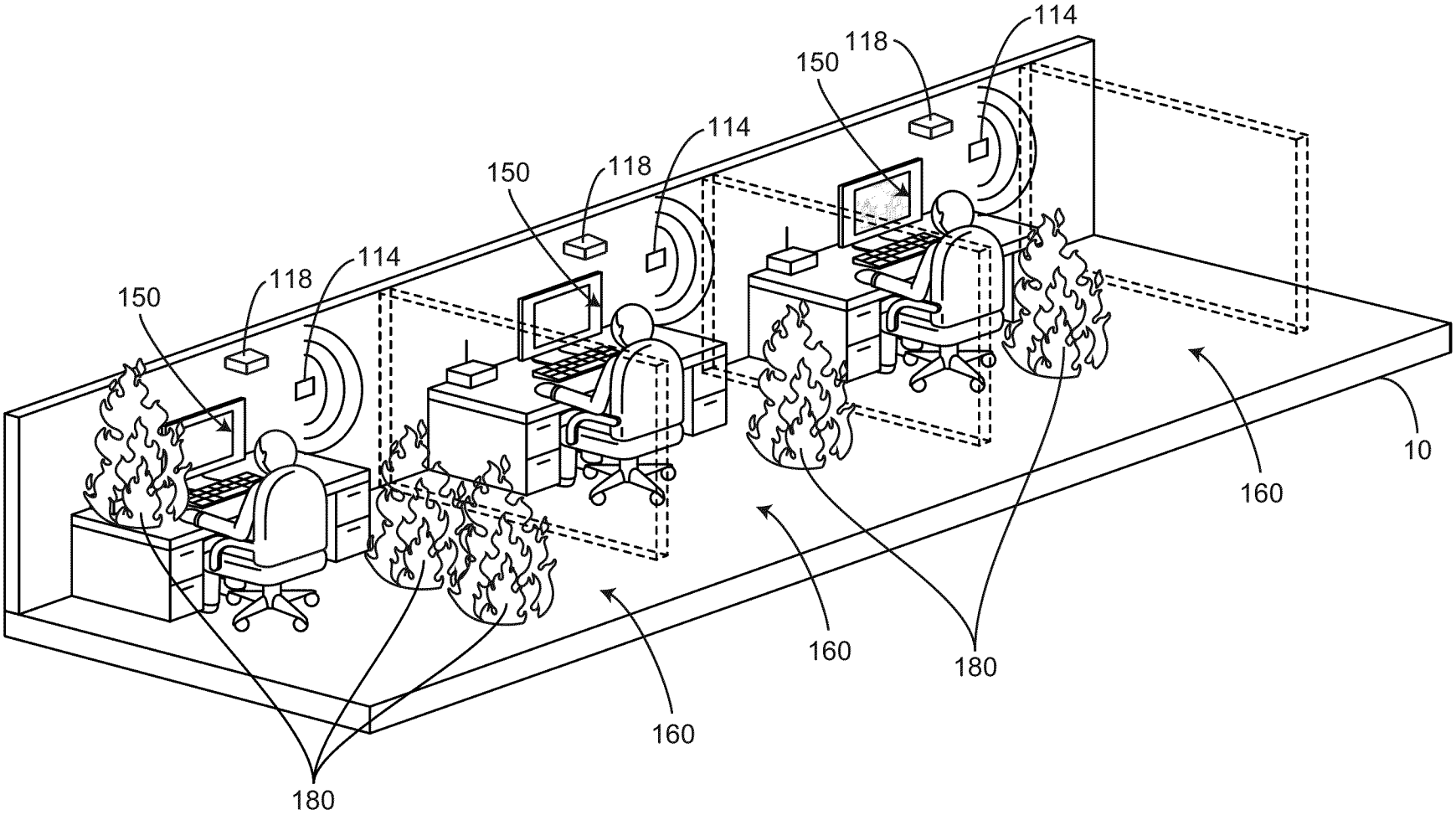
FIG. 4 is a perspective view of various rooms of the building of FIG. 1, including occupants, notification devices, and fire detection devices of the fire system, according to some embodiments.

Referring now to FIGS. 1, 3, and 4, fire system 100 can also include fire detection devices 118, fire notification devices 114, and fire suppression devices 116 positioned in various rooms/spaces 160 of building 10. Fire suppression devices 116 may include sprinklers, fire extinguishers, etc., or any other device configured to suppress a fire. Fire suppression devices 116 may be positioned in various rooms 160 of building 10. Fire suppression devices 116 may be connected to piping system 108 and serve as one of the corrective actions taken by fire system 100 to suppress fires. In some embodiments, fire suppression devices 116 can engage in suppressive action using dry agents (inert gasses, specifically formulated fire suppression gasses or liquids, foam, dry chemical, etc.) instead of water. One or more of the fire suppression devices may be a portable device capable of discharging a fire suppressing agent (e.g., water, foam, gas, etc.) onto a fire. Building 10 may include fire extinguishers (e.g., portable fire suppression devices) on several floors in multiple rooms 160. Fire system 100 can also include one or more pull stations 119 configured to receive a manual input from an occupant 150 of building 10 to indicate the presence of a fire. Pull stations 119 may include a lever, a button, etc., configured to receive a user input indicating that a fire has occurred in building 10. In some embodiments, pull stations 119 are configured to provide a signal to fire alarm control panel 112 regarding a status of the lever, button, etc. When an occupant 150 pulls the lever or pushes the button (or more generally inputs to any of pull stations 119 that there is an emergency situation in building 10), pull stations 119 provide fire alarm control panel 112 with an indication that an occupant 150 of building 10 has actuated one of the pull stations 119. In some embodiments, the indication includes an identification of the particular pull station 119 that has been actuated and a location of the particular pull station 119 (e.g., what floor the fire is at, what room the fire is in, etc.).

Fire notification devices 114 can be any devices capable of relaying audible, visible, or other stimuli to alert building occupants of a fire or other emergency condition. In some embodiments, fire notification devices 114 are powered by Initiating Device Notification Alarm Circuit (IDNAC) power from fire alarm control panel 112. In some embodiments, fire notification devices 114 may be powered by a DC power source (e.g. a battery). In some embodiments, fire notification devices 114 are powered by an external AC power source. Fire notification devices 114 can include a light notification device and a sound notification device. The light notification device can be implemented as any component in fire notification devices 114 that alerts occupants 150 of an emergency by emitting visible signals. In some embodiments, fire notification devices 114 include a strobe light configured to emit strobe flashes (e.g., at least 60 flashes per minute) to alert occupants 150 of building 10 of an emergency situation or regarding the presence of a fire 180. A sound notification device can be any component in fire notification devices 114 that alerts occupants of an emergency by providing an aural alert/alarm. In some embodiments, fire notification devices 114 emit signals ranging from approximately 500 Hz (low frequency) to approximately 3 kHz (high frequency).

Fire alarm control panel 112 can be any computer capable of collecting and analyzing data from the fire notification system (e.g., building controllers, conventional panels, addressable panels, etc.). In some embodiments, fire alarm control panel 112 is directly connected to fire notification device 114 through IDNAC power. In some embodiments, fire alarm control panel 112 can be communicably connected to a network for furthering the fire suppression process, including initiating corrective action in response to detection of a fire.

In some embodiments, fire detection devices 118 are configured to detect a presence of fire in an associated room 160. Fire detection devices 118 may include any temperature sensors, light sensors, smoke detectors, etc., or any other sensors/detectors that detect fire. In some embodiments, fire detection devices 118 provide any of the sensed information to fire alarm control panel 112.

Referring now to FIG. 4, a perspective view of various rooms of building 10 is shown, according to some embodiments. In some embodiments, fire detection devices 118 are configured to monitor any of a temperature, a light intensity, a presence of smoke, etc., of a room/space 160 of building 10. Fire detection devices 118 can be configured to locally perform a fire detection algorithm to determine if a fire 180 is present in room/space 160 based on the sensed data (e.g., the sensed room temperature, the sensed light intensity in room 160, the sensed smoke in room 160, etc.), according to some embodiments. In some embodiments, fire detection devices 118 provide any of the sensed information (e.g., the room temperature of room 160, the light intensity within room 160, the presence of smoke within room 160, etc.) to fire alarm control panel 112. Fire alarm control panel 112 is configured to receive any of the sensor information from any of fire detection devices 118 throughout building 10 and perform a fire detection algorithm to determine if a fire 180 is present in any rooms/spaces 160 of building 10, according to some embodiments. In some embodiments, fire alarm control panel 112 is configured to cause fire notification devices 114 to provide any of a visual and/or an aural alert to occupants 150 in response to determining that a fire 180 is present in one of rooms 160 of building 10. In some embodiments, fire alarm control panel 112 is configured to cause a specific fire notification device 114 to provide an alarm/alert to an occupant 150 of a particular room/space 160 in response to determining that a fire 180 is present in the particular room/space 160 of building 10. In some embodiments, fire alarm control panel 112 is configured to provide BMS controller 366 with a status of any of fire notification devices 114 and/or any of the collected information/data from fire detection devices 118. For example, fire alarm control panel 112 may provide BMS controller 366 with an indication of a current status (e.g., normal mode, alarm mode, etc.) of any of fire notification devices 114. In some embodiments, fire alarm control panel 112 is configured to cause one or more of fire suppression device 116 to suppress the fire in response to determining that a fire is present in building 10. In some embodiments, fire alarm control panel 112 is configured to cause a particular fire suppression device 116 to suppress a fire in a particular room/space 160 in response to determining that a fire 180 is present in the particular room/space 160. In some embodiments, fire alarm control panel 112 is configured to provide BMS controller 366 with a status (e.g., activated, dormant, etc.) of any or all of fire suppression devices 116.

Figure 2:
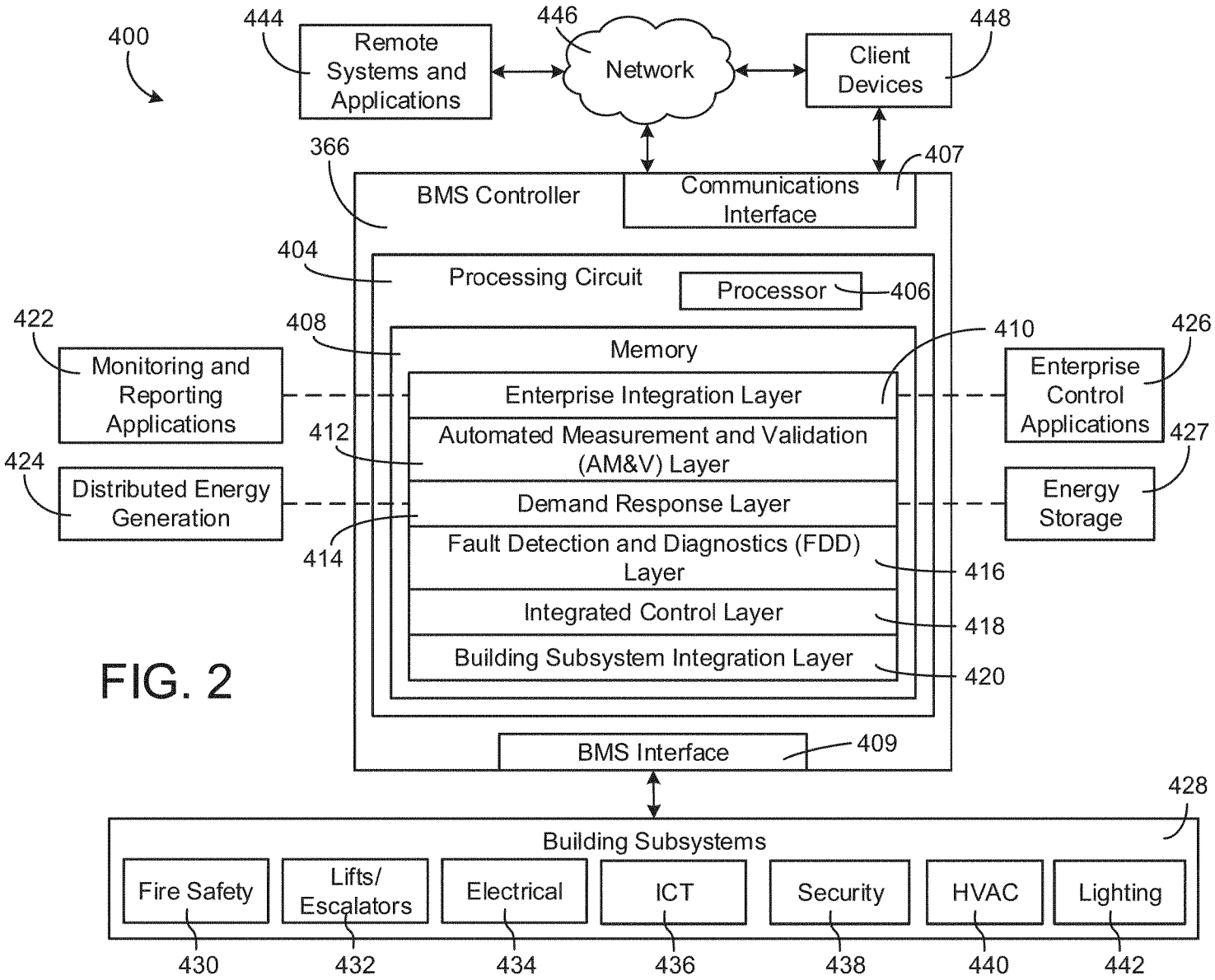
FIG. 2 is a block diagram of a BMS controller that can be used in the building of FIG. 1, according to some embodiments.

Referring now to FIG. 2, a block diagram of a building management system (BMS) 400 is shown, according to an example embodiment. BMS 400 can be implemented in building 10 to automatically monitor and control various building functions. BMS 400 is shown to include BMS controller 366 and a plurality of building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300.

Each of building subsystems 428 can include any number of devices, controllers, and connections for completing its individual functions and control activities. HVAC subsystem 440 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 442 can include any number of light fixtures, ballasts, lighting sensors, dimmers, or other devices configured to controllably adjust the amount of light provided to a building space. Security subsystem 438 can include occupancy sensors, video surveillance cameras, digital video recorders, video processing servers, intrusion detection devices, access control devices (e.g., card access, etc.) and servers, or other security-related devices. Moreover, in some embodiments, lighting subsystem 442 hosts sensors that are used to provide information and/or control signals to other building systems or data enabled services.

Still referring to FIG. 2, BMS controller 366 is shown to include a communications interface 407 and a BMS interface 409. Interface 407 can facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 can also facilitate communications between BMS controller 366 and client devices 448. BMS interface 409 can facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 can be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a wireless communications transceiver for communicating via a wireless communications network (e.g., a WiFi transceiver, a ZigBee tranciever, a LoRa transceiver, a LiFI transceiver, etc.). In another example, one or both of interfaces 407, 409 can include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 2, BMS controller 366 is shown to include a processing circuit 404 including a processor 406 and memory 408. Processing circuit 404 can be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 408 can be or include volatile memory or non-volatile memory. Memory 408 can include database components, object code components, script components, or any other type of information structure for supporting the various activities and information structures described in the present application. According to an example embodiment, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 can be distributed across multiple servers or computers (e.g., that can exist in distributed locations). Further, while FIG. 4 shows applications 422 and 426 as existing outside of BMS controller 366, in some embodiments, applications 422 and 426 can be hosted within BMS controller 366 (e.g., within memory 408).

Still referring to FIG. 2, memory 408 is shown to include an enterprise integration layer 410, an automated measurement and validation (AM&V) layer 412, a demand response (DR) layer 414, a fault detection and diagnostics (FDD) layer 416, an integrated control layer 418, and a building subsystem integration later 420. Layers 410-420 can be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 can be configured to serve clients or local applications with information and services to support a variety of enterprise-level applications. For example, enterprise control applications 426 can be configured to provide subsystem-spanning control to a graphical user interface (GUI) or to any number of enterprise-level business applications (e.g., accounting systems, user identification systems, etc.). Enterprise control applications 426 can also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 can be configured to manage communications between BMS controller 366 and building subsystems 428. For example, building subsystem integration layer 420 can receive sensor data and input signals from building subsystems 428 and provide output data and control signals to building subsystems 428. Building subsystem integration layer 420 can also be configured to manage communications between building subsystems 428. Building subsystem integration layer 420 translate communications (e.g., sensor data, input signals, output signals, etc.) across a plurality of multi-vendor/multi-protocol systems.

Demand response layer 414 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 424, from energy storage 427 (e.g., hot thermal energy storage, cold thermal energy storage, etc.), or from other sources. Demand response layer 414 can receive inputs from other layers of BMS controller 366 (e.g., building subsystem integration layer 420, integrated control layer 418, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to an example embodiment, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 can also include control logic configured to determine when to utilize stored energy. For example, demand response layer 414 can determine to begin using energy from energy storage 427 just prior to the beginning of a peak use hour.

In some embodiments, demand response layer 414 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 414 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 414 can further include or draw upon one or more demand response policy definitions (e.g., databases, XML files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 can be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In an example embodiment, integrated control layer 418 includes control logic that uses inputs and outputs from a plurality of building subsystems to provide greater comfort and energy savings relative to the comfort and energy savings that separate subsystems could provide alone. For example, integrated control layer 418 can be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 can be configured to enhance the effectiveness of demand response layer 414 by enabling building subsystems 428 and their respective control loops to be controlled in coordination with demand response layer 414. This configuration may advantageously reduce disruptive demand response behavior relative to conventional systems. For example, integrated control layer 418 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 can be configured to provide feedback to demand response layer 414 so that demand response layer 414 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 can be configured to provide calculated inputs (e.g., aggregations) to these higher levels based on outputs from more than one building subsystem.

Automated measurement and validation (AM&V) layer 412 can be configured to verify that control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 can be based on building system energy models and/or equipment models for individual BMS devices or subsystems. For example, AM&V layer 412 can compare a model-predicted output with an actual output from building subsystems 428 to determine an accuracy of the model.

Fault detection and diagnostics (FDD) layer 416 can be configured to provide on-going fault detection for building subsystems 428, building subsystem devices (i.e., building equipment), and control algorithms used by demand response layer 414 and integrated control layer 418. FDD layer 416 can receive data inputs from integrated control layer 418, directly from one or more building subsystems or devices, or from another data source. FDD layer 416 can automatically diagnose and respond to detected faults. The responses to detected or diagnosed faults can include providing an alert message to a user, a maintenance scheduling system, or a control algorithm configured to attempt to repair the fault or to work-around the fault.

FDD layer 416 can be configured to output a specific identification of the faulty component or cause of the fault (e.g., loose damper linkage) using detailed subsystem inputs available at building subsystem integration layer 420. In other example embodiments, FDD layer 416 is configured to provide "fault" events to integrated control layer 418 which executes control strategies and policies in response to the received fault events. According to an example embodiment, FDD layer 416 (or a policy executed by an integrated control engine or business rules engine) can shut-down systems or direct control activities around faulty devices or systems to reduce energy waste, extend equipment life, or assure proper control response.

FDD layer 416 can be configured to store or access a variety of different system data stores (or data points for live data). FDD layer 416 can use some content of the data stores to identify faults at the equipment level (e.g., specific chiller, specific AHU, specific terminal unit, etc.) and other content to identify faults at component or subsystem levels. For example, building subsystems 428 can generate temporal (i.e., time-series) data indicating the performance of BMS 400 and the various components thereof. The data generated by building subsystems 428 can include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Fire Detection System

Figure 6:
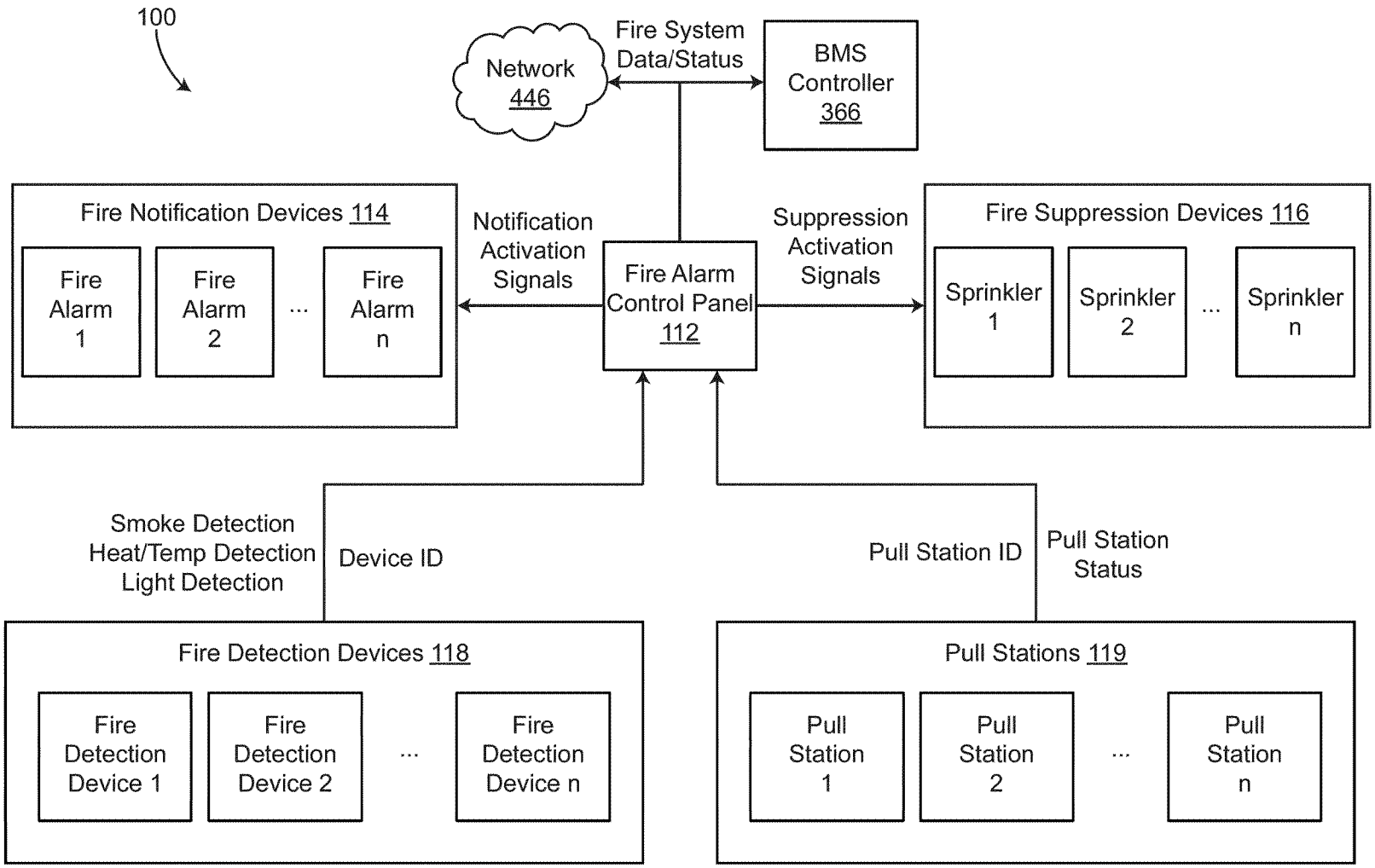
FIG. 6 is a block diagram of the fire system of FIG. 1, according to some embodiments.

Referring now to FIG. 6, fire system 100 is shown, according to some embodiments. As shown, fire alarm control panel 112 is configured to receive any fire detection data (e.g., smoke detection, heat/temperature detection, light intensity detection, etc.) from any of fire detection devices 118, according to some embodiments. In some embodiments, fire alarm control panel 112 also receives a unique device ID from each of fire detection devices 118. In some embodiments, fire alarm control panel 112 is configured to determine a location in building 10 of each of fire detection device 118 based on the unique device ID received from each of fire detection devices 118. For example, fire alarm control panel 112 can determine that a particular fire detection device 118 is in a certain room, on a certain floor of building 10. In some embodiments, fire alarm control panel 112 also receives pull station status information from any of pull stations 119 throughout building 10. In some embodiments, fire alarm control panel 112 is configured to receive a unique pull station ID (e.g., an identification number, an identification name, a unique ID code, etc.) from each of pull stations 119. In some embodiments, fire alarm control panel 112 is configured to perform a fire detection algorithm based on any of the pull station status information received from pull stations 119 and the fire detection data received from fire detection devices 118. Fire alarm control panel 112 can also determine an approximate location of a fire based on the received device IDs of fire detection devices 118 and the received pull station IDs from pull stations 119. In some embodiments, fire alarm control panel 112 is configured to cause fire notification devices 114 and/or fire suppression devices 116 to activate in response to determining that a fire is present in building 10. In some embodiments, fire alarm control panel 112 uses a database of locations corresponding to each of the unique device IDs of fire detection devices 118 and pull stations 119. In some embodiments, fire alarm control panel 112 is configured to determine an approximate location in building 10 of the fire. In some embodiments, fire alarm control panel 112 is configured to cause particular fire notification devices 114 and particular fire suppression devices 116 to activate in response to determining that a fire is present in a particular room 160 of building 10.

For example, fire alarm control panel 112 may cause all of fire notification devices 114 to activate in response to determining that a fire is present in any room 160 of building 10. In some embodiments, fire alarm control panel 112 is configured to cause only fire suppression devices 116 that are proximate the location of the detected fire to activate. For example, fire alarm control panel 112 may cause all fire notification devices 114 to activate in response to determining a fire is present in one room 160 of building 10 (to cause occupants 150 to evacuate building 10) but may only activate fire suppression devices 116 that are in the particular room that the fire is present.

In some embodiments, fire detection devices 118 are configured to perform a fire detection algorithm locally and are communicably connected with fire notification devices 114. In some embodiments, fire detection devices 118 are configured to provide fire alarm control panel 112 with an indication of whether a fire is present nearby fire detection devices 118. In some embodiments, fire detection devices 118 are configured to cause fire notification devices 114 to activate in response to determining that a fire is present nearby. In some embodiments, fire detection devices 118 are configured to control an operation of fire suppression devices 116. In some embodiments, fire detection devices 118 are configured to cause one or more (e.g., the nearest) of fire suppression devices 116 to activate in response to detecting a fire.

In some embodiments, fire alarm control panel 112 is configured to provide a status of fire system 100 to network 446 and/or BMS controller 366. For example, fire alarm control panel 112 may provide a status of each of fire suppression devices 116 (e.g., activated or dormant), a status of each of fire notification devices 114 (e.g., activated or dormant), a status of each of fire detection devices 118 (e.g., fire detected, no fire detected), and a status of each of pull stations 119 (e.g., activated). In some embodiments, fire alarm control panel 112 also provides network 446 and/or BMS controller 366 with a location of each of fire notification devices 114, fire suppression devices 116, fire detection devices 118, and pull stations 119. In some embodiments, the location includes a floor, room, and relative location within the room of each of fire notification devices 114, each of fire suppression devices 116, each of fire detection devices 118, and each of pull stations 119. For example, fire alarm control panel 112 may provide BMS controller 366 with a status of a particular fire detection device 116, as well as what floor the particular fire detection device 116 is on, as well as a room 160 that the particular fire detection device 116 is in and what wall of the room (e.g., north wall, west wall, etc.) 160 the particular fire detection device 116 is located on. In some embodiments, fire alarm control panel 112 is configured to provide BMS controller 366 with any of the received information from any or all of fire detection devices 118, any or all of pull stations 119, etc. For example, fire alarm control panel 112 may provide BMS controller 366 with any of the smoke detection data, the temperature sensor data, the light intensity data, etc., of each of fire detection devices 118 as well as the corresponding room 160 that each of fire detection devices 118 are located within.

Fire Safety Device

Figure 5:
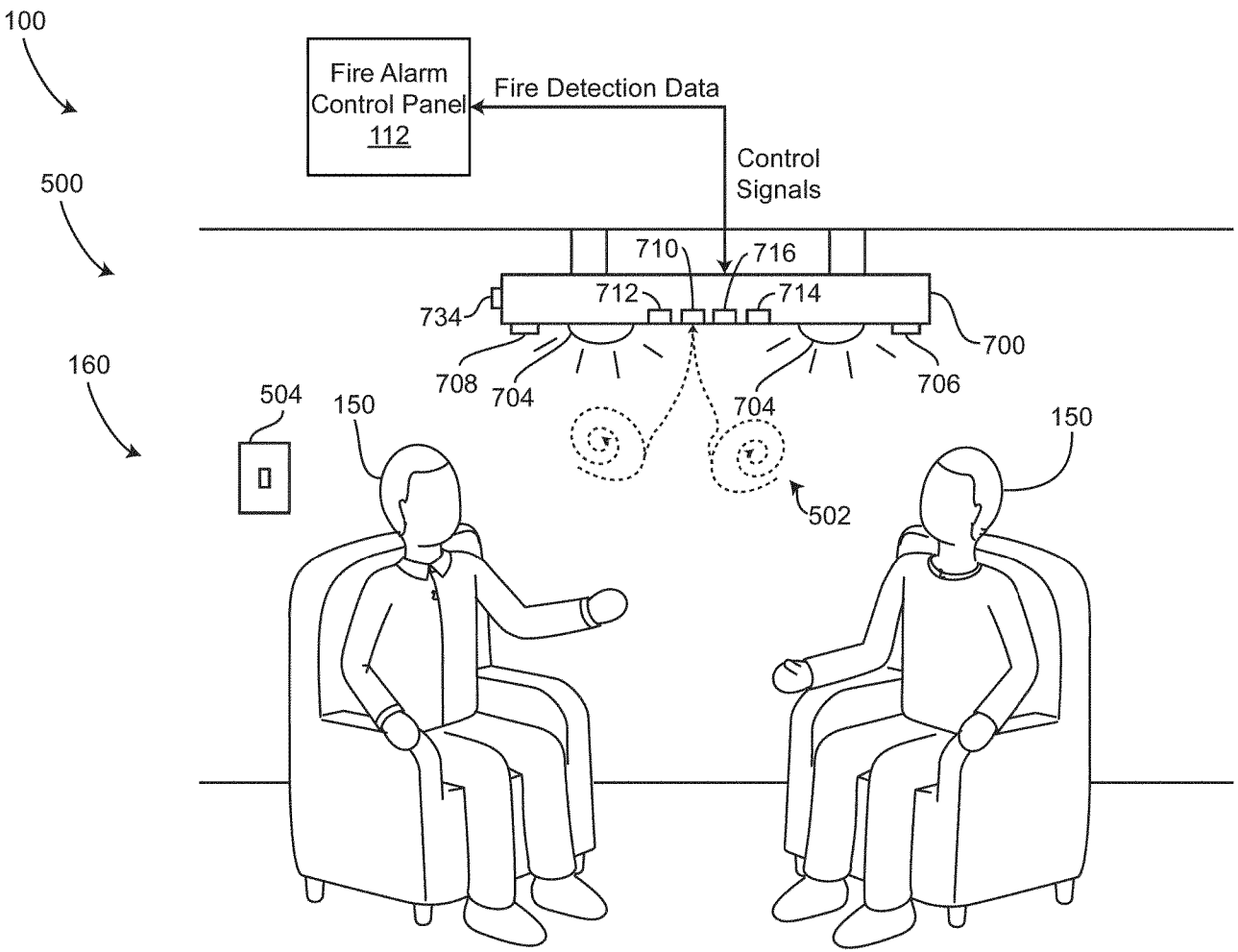
FIG. 5 is a drawing of one of the rooms of the building of FIG. 1, including a fire safety device of the fire system, according to some embodiments.
Figure 7:
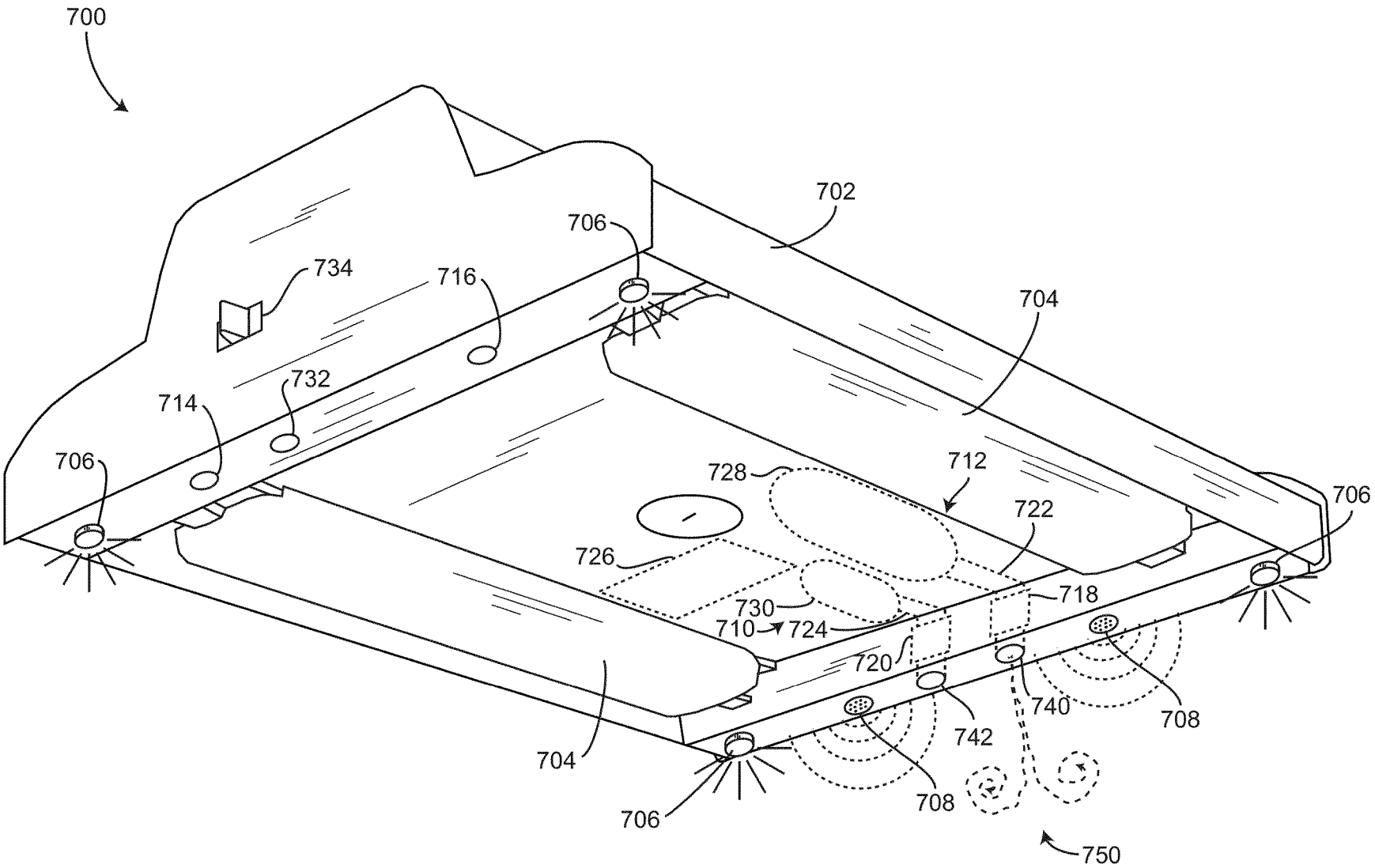
FIG. 7 is a perspective view of the fire safety device of FIG. 5, according to some embodiments.

Referring now to FIGS. 5 and 7, a portion of fire system 100 is shown, according to some embodiments. As shown in FIG. 5, fire alarm control panel 112 is configured to receive fire detection data from a fire safety device 700. In some embodiments, fire safety device 700 is configured to perform any of the functionality of fire detection devices 118, fire notification devices 114, and pull stations 119. In some embodiments, fire safety device 700 is also configured to perform the functionality of lighting for room 160. For example, fire safety device 700 may have the appearance of a chandelier, a lamp, an overhead light, a pendant light, an upright light, a wall light, a recessed light, a spot light, a wall sconce, a track light, a desk lamp, an under cabinet light, a vanity light, an accent light, a landscape light, a luminaire, etc., or any other lighting device. Some fire detection devices and fire notification devices are aesthetically displeasing and do not match the décor of the room. Advantageously, fire safety device 700 can be used to detect fires, provide notifications to users, and is visually appealing. Occupants 150 may not even realize that fire safety device 700 is a fire detection/notification device, and may merely believe that it is an illuminating device. Advantageously, fire safety device 700 is a discrete fire detection/alarm device that can improve the appearance of room 160, and perform one or more fire detection/alarm functions.

Fire safety device 700 can perform any of the functionality of a typical lighting apparatus/illuminated device. For example, fire safety device 700 can be configured to provide illuminating light to room 160, and the illuminating functionality may be controlled by occupants 150 at a wall switch 504, remotely (e.g., via a phone), etc. For example, fire safety device 700 can receive commands from occupants 150 via switch 504 to turn on and provide light to room 160 or to turn off.

Fire safety device 700 includes one or more light emitting devices 704 (e.g., lights, lightbulbs, LEDs, etc.) configured to provide light to room 160 for occupants 150, according to some embodiments. Light emitting devices 704 are configured to provide illumination for the occupants 150 of room 160 for daily activities (e.g., for the purpose of visibility, etc.), according to some embodiments. In some embodiment, fire safety device 700 is configured to provide ambient lighting for room 160.

Fire safety device 700 includes an alert light 706, according to some embodiments. In some embodiments, alert light 706 is configured to provide a visual alert to occupants 150 in response to fire safety device 700 or fire alarm control panel 112 determining that a fire is present in room 160 or in building 10. In some embodiments, alert light 706 is a strobe light configured to intermittently illuminate to provide a visual alert to occupants 150. In some embodiments, alert light 706 is a blinking light configured to intermittently blink between an on state and an off state to provide a visual alert to occupants 150. In some embodiments, alert light 706 is both an alert light as well as a lighting device to provide ambient, spotlight, environmental light, etc., for occupants of room 160. In this way, alert light 706 can function as both an alert light and a light that provides environmental light. In some embodiments, alert light 706 is or includes one or more LEDs. In some embodiments, alert light 706 can also be used to provide adequate emergency egress lighting, thereby serving as an emergency light as well. In some embodiments, during an alarm condition, alert light 706 can be operated to provide adequate egress lighting and can also provide an increased level of illumination in a fire strobe pattern. In some embodiments, fire safety device 700 includes a battery or a collection of batteries that are used to power alert light 706, or any other alert devices, sensors, light emitting devices, sound emitting devices, etc., during a loss of main power in the building.

Fire safety device 700 includes a sound emitting device 708, according to some embodiments. In some embodiments, sound emitting device 708 is a speaker, a buzzer, an alarm, a beeper, etc., configured to provide an aural alert to occupants 150. In some embodiments, sound emitting device 708 is configured to provide the aural alert to occupants 150 in response to a determination that a fire is present in room 160 or in building 10. The aural alert may be any of a siren noise, a beeping noise, a buzzing noise, an automated voice, etc., to notify occupants 150 to evacuate room 160 and/or building 10 or to notify occupants 150 regarding the presence of a detected fire in room 160 and/or building 10.

In some embodiments, fire safety device 700 includes a smoke emission system 712. Smoke emission system 712 is configured to emit a controlled amount of smoke 750 into room 160 for a smoke detection test, according to some embodiments. Advantageously, the smoke detection test can be used to ensure fire safety device 700 is operating properly and can detect smoke in room 160, thereby decreasing the likelihood of fire safety device 700 failing during operation. Additionally, fire safety device 700 can use the smoke detection test to automatically self-test. This reduces the need for a technician to manually inject some amount of smoke into room 160 to test fire safety device 700.

In some embodiments, fire safety device 700 includes a smoke detection system 710. Smoke detection system 710 is configured to monitor a presence of smoke in room 160, according to some embodiments. Smoke detection system 710 can be used to monitor a presence of smoke 750 emitted by smoke emission system 712 to perform the smoke detection test. In some embodiments, smoke detection system 710 is used to monitor the presence of smoke 502 present in room 160 (e.g., due to a fire present in room 160, due to food burning in an oven in room 160, etc.).

In some embodiments, fire safety device 700 includes a light sensor 716. In some embodiments, light sensor 716 is a single light sensor, or a collection of light sensors. Light sensor 716 is configured to measure light intensity in room 160, according to some embodiments. In some embodiments, light sensor 716 is any of a photovoltaic light sensor (e.g., a solar cell), a photoresistor, a photodiode, a proximity sensor, etc. Light sensor 716 can be used to perform a visual notification test, according to some embodiments.

In some embodiments, fire safety device 700 includes a temperature sensor 714. In some embodiments, temperature sensor 714 is a single temperature sensor or a collection of temperature sensors. In some embodiments, temperature sensor 714 is configured to monitor/measure a temperature within room 160. In some embodiments, temperature sensor 714 is or includes any of a thermistor, a resistance thermometer, a thermocouple, an infrared temperature sensor, a semiconductor temperature sensor, a thermometer, etc. Temperature sensor 714 can be configured to monitor/measure any or a combination of a room temperature of room 160, a surface temperature of a surface of room 160, etc., or any other temperature within room 160.

In some embodiments, fire safety device 700 includes a user input device 734 (e.g., a switch, a lever, a button, a knob, etc.). In some embodiments, user input device 734 is configured to receive an input from a user, similar to pull stations 119. For example, fire safety device 700 can be configured to notify fire alarm control panel 112 if a user/occupant 150 actuates/provides an input to fire safety device 700 via user input device 734. In some embodiments, the user input to user input device 734 indicates the presence of a fire in room 160 (e.g., a fire alarm).

In some embodiments, fire safety device 700 includes a sound sensor 732. Sound sensor 732 may be any sensor/device configured to monitor a decibel level or receive sound waves within room 160. For example, sound sensor 732 may be a microphone. In some embodiments, sound sensor 732 is any transducer configured to receive sound within room 160 and convert the sound into an electrical signal.

Fire safety device 700 includes a controller 726, according to some embodiments. In some embodiments, controller 726 is configured to receive sensor/data inputs from any of temperature sensor 714, user input device 734, light sensor 716, smoke detection system 710, smoke emission system 712, and sound sensor 732. In some embodiments, controller 726 is configured to control an operation of any of smoke emission system 712, smoke detection system 710, alert light(s) 706, sound emitting device 708, and light emitting devices 704. In some embodiments, the devices/systems/sensors that controller 726 can control the operation of are referred to as "controllable elements." In some embodiments, controller 726 is configured to communicably communicate with fire alarm control panel 112 to provide fire alarm control panel 112 with fire detection data. For example, controller 726 may provide fire alarm control panel 112 with any of the sensed data (e.g., room temperature, light intensity, smoke detection, etc.), a current status/mode of fire safety device 700 (e.g., alarm mode, test mode, normal mode, etc.), etc. In some embodiments, controller 726 is configured to receive control signals from fire alarm control panel 112 and adjust an operation of any of the controllable elements based on the control signals received from fire alarm control panel 112. In some embodiments, controller 726 is configured to cause fire safety device 700 to perform any of a light emission test, a sound emission test, and the smoke detection test. In some embodiments, controller 726 is configured to perform any of the light emission test, the sound emission test, and the smoke detection test in response to receiving a command from fire alarm control panel 112 to perform a particular test.

In some embodiments, fire safety device 700 is configured to perform a fire detection process to determine if a fire is present in room 160 based on any of the input information from the various sensors, systems, and devices of fire safety device 700. In some embodiments, fire safety device 700 is configured to provide any of a visual and/or an aural alert via the controllable elements to occupants 150 in response to determining that a fire is present in room 160. In some embodiments, controller 726 is configured to provide fire alarm control panel 112 with the input information from any of the sensors, systems, devices, etc., of fire safety device 700 and fire alarm control panel 112 is configured to perform the fire detection algorithm. In some embodiments, controller 726 is configured to receive a command from fire alarm control panel 112 to provide the visual and/or the aural alert to occupants 150. In some embodiments, fire alarm control panel 112 is configured to use any of the information received from fire safety device 700 to determine if a fire is present in room 160 and cause fire safety device 700 to provide the visual and/or the aural alert to occupants 150 in response to determining that a fire is present in room 160.

Referring to FIG. 7, fire safety device 700 is shown in greater detail, according to some embodiments. Fire safety device 700 includes a housing 702 configured to contain/provide structural support for any of the components of fire safety device 700, according to some embodiments. In some embodiments, housing 702 has the overall appearance of a luminaire, a lighting fixture, etc., or any of the other examples described in greater detail above with reference to FIGS. 5 and 7. In some embodiments, housing 702 includes controller 726, smoke emission system 712, and smoke detection system 710 within an inner volume, such that controller 726, smoke emission system 712, and smoke detection system 710 are substantially completely concealed from occupants 150. This results in the fire detection and notification functionality of fire safety device 700 essentially invisible to occupants 150 until a visual and/or aural alert is provided (e.g., until fire safety device 700 transitions into an alarm mode). Housing 702 may include fasteners or fastener receivers (e.g., apertures, holes, threaded bores, etc.) configured to interface with fasteners to mount fire safety device 700. In some embodiments, fire safety device 700 can be mounted to a wall, a ceiling, a desk, etc., of room 160.

Referring still to FIG. 7, smoke emission system 712 includes a smoke container 728, according to some embodiments. Smoke container 728 may be any tank, capsule, cartridge, reservoir, vessel, storage device, etc., configured to contain smoke in an inner volume. In some embodiments, smoke container 728 is fluidly coupled with a smoke delivery system 722 (e.g., an air sampling transport system). Smoke delivery system 722 is or includes any pipes, tubes, channels, tubular members, conduit, etc., configured to fluidly couple with the inner volume of smoke container 728 and provide the smoke contained therein to room 160, according to some embodiments. In some embodiments, smoke delivery system 722 includes an outlet aperture 740 at an outer surface of housing 702. In some embodiments, outlet aperture 740 is configured to provide the smoke from smoke delivery system 722 to room 160. In some embodiments, smoke delivery system 722 includes one or more valves positioned along a fluid flow path between the inner volume of smoke container 728 and outlet aperture 740. For example, the one or more valves may be positioned along the fluid flow path at an outlet of smoke container 728. In some embodiments, the one or more valves are configured to actuate between an open position and a closed position. In some embodiments, the open position allows the egress of smoke from the inner volume of smoke container 728 for the smoke detection test.

In some embodiments, smoke delivery system 722 includes an actuator 718 positioned along the fluid flow path between the inner volume of smoke container 728 and outlet aperture 740. In some embodiments, actuator 718 is configured to adjust any of a volumetric flow rate, a mass flow rate, and a speed of smoke exiting outlet aperture 740. In some embodiments, actuator 718 is controlled by controller 726. In some embodiments, controller 726 adjusts an operation of actuator 718 to provide a specific amount of smoke to room 160 for the smoke detection test. In some embodiments, actuator 718 is any of a valve, a flow regulator, a gate valve, a globe valve, a pinch valve, a needle valve, a ball valve, a diaphragm valve, etc. Actuator 718 can be positioned anywhere along the fluid flow path defined between the inner volume of smoke container 728 and outlet aperture 740. In some embodiments, actuator 718 is configured to provide a metered amount of smoke to room 160.

Referring still to FIG. 7, smoke detection system 710 is shown to include a sensing chamber 730, an air sample delivery system 724 (e.g., a smoke transport system), and an inlet aperture 742. In some embodiments, sensing chamber 730 is or includes one or more ionization chambers configured to detect a presence of smoke within an inner volume of sensing chamber 730. In some embodiments, sensing chamber 730 is or includes one or more photoelectric/optical smoke detection chambers configured to detect a presence of smoke within the inner volume of sensing chamber 730. In some embodiments, sensing chamber 730 is or includes one or more carbon monoxide or carbon dioxide sensors configured to monitor a presence of carbon monoxide or carbon dioxide within the inner volume of sensing chamber 730. In some embodiments, sensing chamber 730 includes any of an ionization chamber, a photoelectric/optical smoke detection chamber, and a carbon monoxide/carbon dioxide sensor. In some embodiments, sensing chamber 730 is or includes an aspirating smoke detector/sensor. In some embodiments, sensing chamber 730 is or includes a laser smoke detector. Sensing chamber 730 may be any chamber, device, detector, sensor, etc., configured to monitor/measure the presence of smoke (or particulate matter) within the inner volume of sensing chamber 730.

In some embodiments, air sample delivery system 724 defines a flow path between inlet aperture 742 and the inner volume of sensing chamber 730. In some embodiments, air sample delivery system 724 is or includes any pipes, tubes, channels, tubular members, conduit, etc., configured to fluidly couple the inner volume of sensing chamber 730 with inlet aperture 742. In some embodiments, inlet aperture 742 is positioned at an outer surface of housing 702 of fire safety device 700. In some embodiments, inlet aperture 742 is configured to fluidly couple air sample delivery system 724 with the space within room 160. Likewise, outlet aperture 740 is configured to fluidly couple air sample delivery system 724 with the space within room 160, according to some embodiments. In some embodiments, inlet aperture 742 and outlet aperture 740 are positioned near each other such that smoke emitted from outlet aperture 740 can be received through inlet aperture 742. In some embodiments, inlet aperture 742 and outlet aperture 740 are adjacent each other. In some embodiments, outlet aperture 740 is oriented, positioned, configured, etc., such that smoke exiting outlet aperture 740 enters inlet aperture 742. For example, outlet aperture 740 may be pointed towards inlet aperture 742.

It should be noted that while fire safety device 700 shows only one smoke emission system 712 and one smoke detection system 710, more than one smoke emission system 712 and more than one smoke detection system 710 may be included with fire safety device 700, according to some embodiments. For example, in some embodiments, multiple inlet apertures 742 and/or multiple smoke detection systems 710 are positioned about fire safety device 700 such that the presence of smoke in more than one location can be detected. For example, multiple inlet apertures 742 may be positioned about a perimeter of fire safety device 700 to ensure that any smoke present in room 160 is detected by one or more smoke detection systems 710.

In some embodiments, smoke detection system 710 includes an air moving device 720. Air moving device 720 may be a mechanical fan, a vacuum pump, etc., or any other device configured to draw air into air sample delivery system 724 via inlet aperture 742. In some embodiments, air moving device 720 is optional. For example, natural convection may deliver smoke to sensing chamber 730. In some embodiments, air moving device 720 is positioned along the fluid flow path defined between the inner volume of sensing chamber 730 and inlet aperture 742. In some embodiments, air moving device 720 is disposed inside housing 702. In some embodiments, air moving device 720 is disposed outside of housing 702.

Smoke emission system 712 and smoke detection system 710 can be controlled by controller 726, according to some embodiments. Controller 726 operates smoke emission system 712 to disperse a particular amount of test smoke from smoke container 728 into the air of room 160, according to some embodiments. In some embodiments, the test smoke is received through inlet aperture 742 of smoke detection system 710 and provided to sensing chamber 730. Controller 726 receives an analog signal from sensing chamber 730 and uses the analog signal to determine if smoke detection system 710 is operating properly, according to some embodiments.

Figure 8:
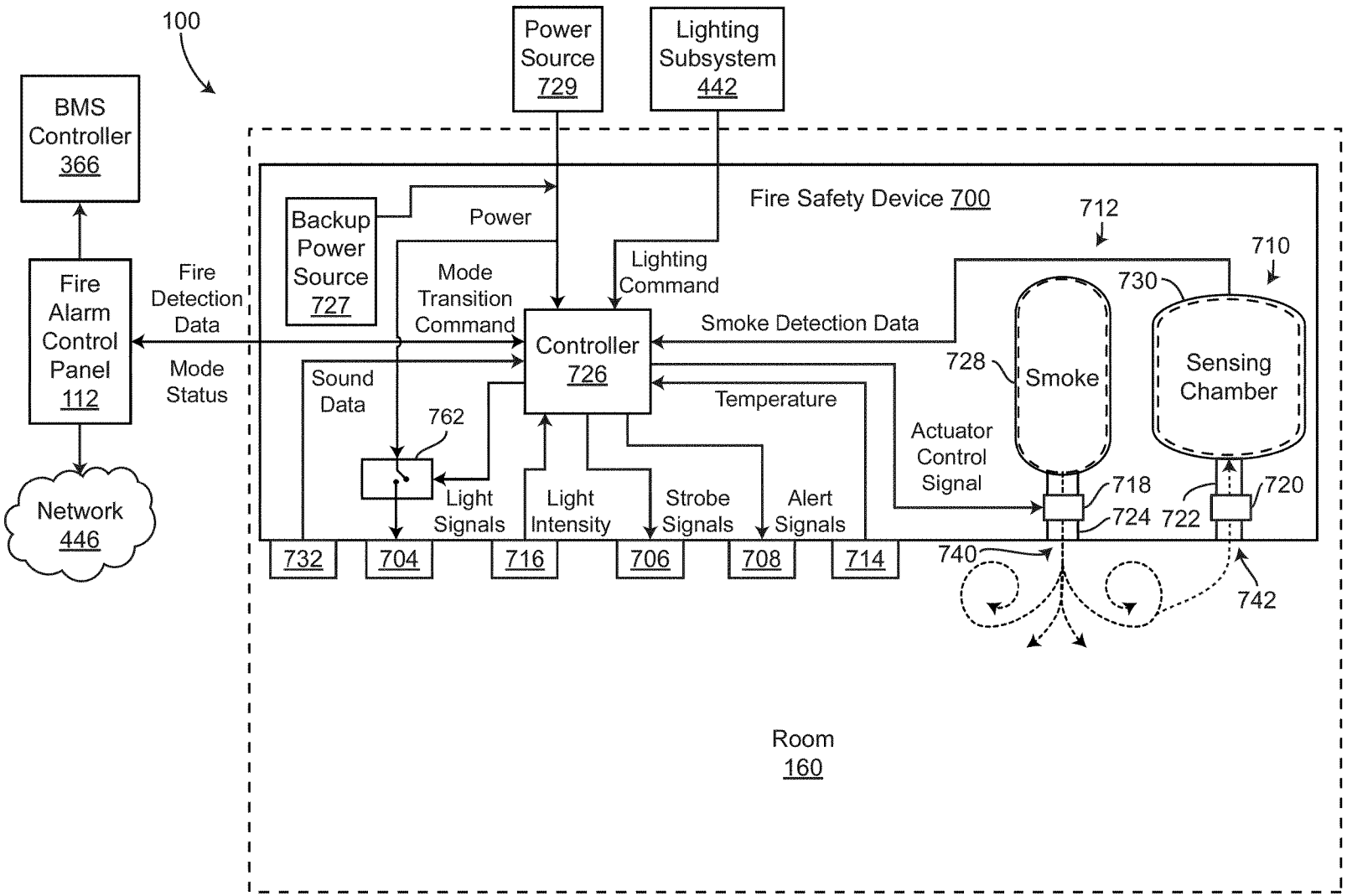
FIG. 8 is a block diagram of the fire safety device of FIG. 5, including a controller, according to some embodiments.

Referring now to FIG. 8, a block diagram of a portion of fire system 100 including fire safety device 700 is shown. In some embodiments, controller 726 or any of the components of fire safety device 700 are configured to receive power from power source 729 to perform any of the functionality described herein. Controller 726 may receive a lighting command from lighting system 442. In some embodiments, controller 726 uses the lighting command to determine if power should be provided to light emitting devices 704. For example, controller 726 may adjust an intensity of light emitted by light emitting devices 704, an operational status (e.g., on/off) of light emitting devices 704, etc. In some embodiments, controller 726 receives a command from a user input device (e.g., switch 504) to adjust an operation of light emitting devices 704 (e.g., to switch light emitting devices 704 on, to switch light emitting devices 704 off, to increase or decrease the intensity of light emitted by light emitting devices 704, etc.).

Controller 726 may adjust an operation of relay 762 to transition light emitting devices 704 between the on state and the off state, according to some embodiments. In some embodiments, relay 762 is configured to receive power from power source 729 and transition between a state where the power is transferred to light emitting devices 704 (e.g., an on-state) and a state where the power is not transferred to light emitting devices 704 (e.g., an off-state). Controller 726 can send a signal to relay 762 to switch relay 762 between the two states to provide power to light emitting devices 704 or to not provide power to light emitting devices 704, according to some embodiments.

In some embodiments, fire safety device 700 includes a backup power source 727. Backup power source 727 may be contained within fire safety device 700. In some embodiments, controller 726 is configured to draw power from backup power source 727 in response to power source 729 failing. For example, power source 729 may be MAINS power (e.g., a wall outlet). If the power to building 10 fails, controller 726 can draw power from backup power source 727 so that fire detection and notification functionality can still be performed.

Controller 726 is configured to control an operation of sound emitting device 708 and alert light 706, according to some embodiments. In some embodiments, controller 726 operates sound emitting device 708 and alert light 706 to provide an aural and a visual alert (respectively) to occupants 150 of room 160. In some embodiments, controller 726 operates sound emitting device 708 and alert light 706 to provide a fire alert (e.g., an aural and a visual fire alert) to occupants 150. In some embodiments, controller 726 operates alert light 706 and sound emitting device 708 to provide the aural/visual fire alerts in response to determining that a fire has occurred or in response to receiving a command from fire alarm control panel 112 to alert occupants 150 of a fire. In some embodiments, controller 726 operates alert light 706 to emit a pulse of light to warn occupants 150. In some embodiments, controller 726 operates sound emitting device 708 to produce a buzzing sound, a warning sound, a siren sound, etc., to alert occupants 150.

Controller 726 is configured to operate actuator 718 to provide a predetermined amount of test smoke to room 160, according to some embodiments. In some embodiments, controller 726 sends actuator control signals to actuator 718 such that the predetermined amount of test smoke is provided to room 160 from smoke container 728. Controller 726 is configured to receive a signal from sensing chamber 730 indicating a presence or a concentration of smoke within the inner volume of sensing chamber 730 or within room 160. In some embodiments, if the smoke detection test is being performed, the signal received from sensing chamber 730 is used to determine if sensing chamber 730 is operating properly. In some embodiments, if the smoke detection test is not being performed, the signal received from sensing chamber 730 indicates the presence of smoke within room 160 and is used to determine if a fire is present in room 160.

Controller 726 is configured to receive sound data from sound sensor 732, according to some embodiments. Controller 726 is also configured to receive light intensity data from light sensor 716, according to some embodiments. Controller 726 is configured to receive temperature data from temperature sensor 714, according to some embodiments. Controller 726 can use any of the sound data from sound sensor 732, the light intensity data from light sensor 716, the temperature data from temperature sensor 714, and the smoke detection data from sensing chamber 730 to determine if a fire is present in room 160. In some embodiments, controller 726 provides any of the sound data from sound sensor 732, the light intensity data from light sensor 716, the temperature data from temperature sensor 714, and the smoke detection data from sensing chamber 730 to fire alarm control panel 112. In some embodiments, fire alarm control panel 112 is configured to use any of the sound data, the light intensity data, the temperature data, and the smoke detection data to determine if a fire has occurred in room 160.

In some embodiments, controller 726 is configured to operate sound emitting device 708 to emit the aural alert and receive sound data from sound sensor 732 to perform a sound emission test. In some embodiments, the sound emission test is performed to determine if sound emitting device 708 is operating properly. In some embodiments, controller 726 uses the sound data received from sound sensor 732 during the sound emission test to determine if sound emitting device 708 is operating properly. In some embodiments, controller 726 provides the sound data collected during the sound emission test to fire alarm control panel 112. In some embodiments, fire alarm control panel 112 uses the sound data collected during the sound emission test to determine if sound emitting device 708 is operating properly. In some embodiments, fire alarm control panel 112 provides controller 726 with a determination if sound emitting device 708 is operating properly. In some embodiments, fire alarm control panel 112 provides a command to controller 726 to perform the sound emission test.

In some embodiments, controller 726 is configured to operate alert light 706 to emit the visual alert (e.g., emit strobing light) and receive light intensity data from light sensor 716 to perform a light emission test. In some embodiments, the light emission test is performed to determine if alert light 706 is operating properly. In some embodiments, controller 726 uses the light intensity data received from light sensor 716 during the light emission test to determine if alert light 706 is operating properly. In some embodiments, controller 726 provides the light intensity data collected during the light emission test to fire alarm control panel 112. In some embodiments, fire alarm control panel 112 uses the light intensity data collected during the light emission test to determine if alert light 706 is operating properly. In some embodiments, fire alarm control panel 112 provides controller 726 with a determination if alert light 706 is operating properly. In some embodiments, fire alarm control panel 112 provides a command to controller 726 to perform the light emission test.

Controller 726 may perform any of the various tests described herein concurrently with each other, according to some embodiments. For example, the sound emission test and the light emission test may be performed concurrently. In some embodiments, when controller 726 performs the smoke detection test, controller 726 temporarily restricts operation of alert light 706 and sound emitting device 708 so that the visual and the aural alerts are not provided during the smoke detection test. In some embodiments, controller 726 still generates the control signals form the aural and visual alarms for sound emitting device 708 and alert light 706 while in the test mode, but does not provide the control signals to sound emitting device 708 and alert light 706. In some embodiments, controller 726 performs the tests sequentially/consecutively. For example, controller 726 may first perform the smoke detection test, then perform the light emission test in response to completing the smoke detection test, and then perform the sound emission test in response to completing the light emission test.

In some embodiments, fire alarm control panel 112 provides any of the data received from fire safety device 700 to BMS controller 366 and/or network 446. For example, fire alarm control panel 112 may provide any of the sensory data (e.g., the light intensity data, the temperature data, the smoke detection data, the sound data, etc.) received from fire safety device 700 to BMS controller 366 and/or network 446. In some embodiments, fire alarm control panel 112 provides a mode (e.g., normal mode, test mode, alarm mode, etc.) of fire safety device 700. In some embodiments, fire safety device 700 has a unique identification (e.g., an ID name, an ID number, a serial number, etc.) and controller 726 provides the unique identification to fire alarm control panel 112. In some embodiments, fire alarm control panel 112 also provides BMS controller 366 and/or network 446 with the unique identification of fire safety device 700. Controller 726 can also provide fire alarm control panel 112 with the results of the fire detection algorithm (e.g., an indication of whether or not a fire is present in room 160) and fire alarm control panel 112 can provide the results to BMS controller 366 and/or network 446. In some embodiments, fire alarm control panel 112 is configured to perform the fire detection algorithm based on the received data from fire safety device 700 and provide the results to any of BMS controller 366 and network 446.

Figure 9:
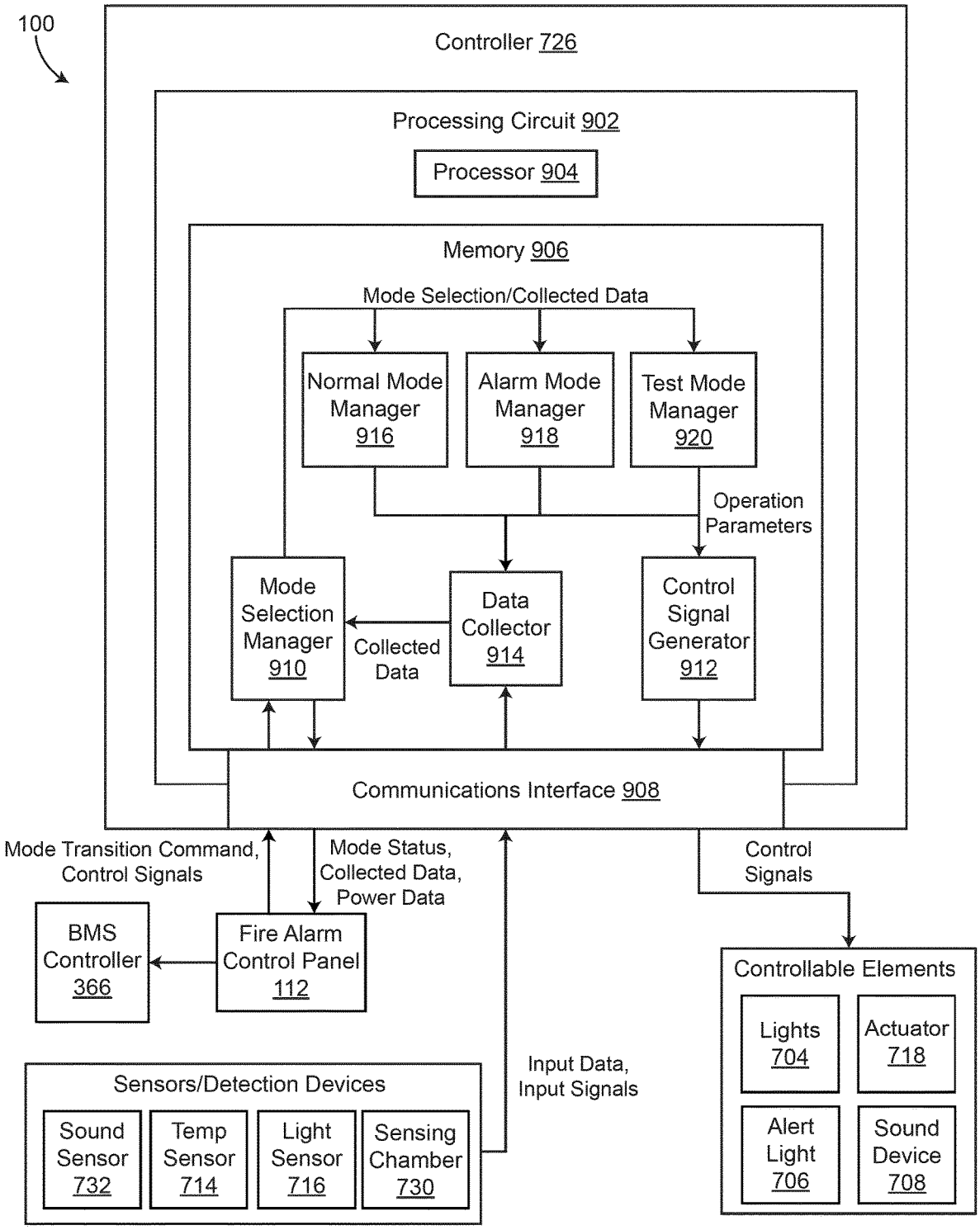
FIG. 9 is a block diagram of the controller of the fire safety device of FIG. 5, according to some embodiments.

Referring now to FIG. 9, a portion of fire system 100 and controller 726 are shown in greater detail. Controller 726 is shown to include a communications interface 908. Communications interface 908 can facilitate communications between controller 726 and any of the sensors, systems, devices, etc., of fire safety device 700. For example, communications interface 908 can facilitate communication between controller 726 and sound sensor 732, temperature sensor 714, light sensor 716, and sensing chamber 730. Communications interface 908 can also facilitate communications between controller 726 and any of the controllable elements of fire safety device 700 such as light emitting devices 704, actuator 718, alert light 706, and sound emitting device 708. Communications interface 908 can also facilitate communications between controller 726 and fire alarm control panel 112, according to some embodiments.

Communications interface 908 can be or include wired or wireless communications interfaces (e.g., jacks, antennas, transmitters, receivers, transceivers, wire terminals, etc.) for conducting data communications with sensors, systems, devices, etc., or external controllers (such as fire alarm control panel 112). In some embodiments, communications via communications interface 908 can be direct (e.g., local wired or wireless communications) or via a communications network (e.g., a WAN, the Internet, a cellular network, etc.). For example, communications interface 908 can include an Ethernet card and port for sending and receiving data via an Ethernet-based communications link or network. In another example, communications interface 908 can include a Wi-Fi transceiver for communicating via a wireless communications network. In another example, communications interface 908 can include cellular or mobile phone communications transceivers. In some embodiments, communications interface 908 is a power line communications interface or an Ethernet interface.

Still referring to FIG. 9, controller 726 is shown to include a processing circuit 902 including a processor 904 and memory 906. Processing circuit 902 can be communicably connected to communications interface 908 that processing circuit 902 and the various components thereof can send and receive data via communications interface 908. Processor 904 can be implemented as a general purpose processor, an application specific integrated circuit (ASIC), one or more field programmable gate arrays (FPGAs), a group of processing components, or other suitable electronic processing components.

Memory 906 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 906 can be or include volatile memory or non-volatile memory. Memory 906 can include database components, object code components, script components, or any other type of information structure for supporting the various activities and information structures described in the present application. In some embodiments, memory 906 is communicably connected to processor 904 via processing circuit 902 and includes computer code for executing (e.g., by processing circuit 902 and/or processor 904) one or more processes described herein.

In some embodiments, controller 726 is implemented within a single computer (e.g., one server, one housing, etc.). In some embodiments, controller 726 can be distributed across multiple servers or computers (e.g., that can exist in distributed locations).

Referring still to FIG. 9, memory 906 is shown to include a data collector 914. In some embodiments, data collector 914 is configured to receive any input data/input signals from the various sensors, detection devices, systems, etc., of fire safety device 700 via communications interface 908. For example, data collector 914 may receive data from sensing chamber 730 during the smoke detection test. Data collector 914 can also be configured to receive analog signals (e.g., analog signals from sensing chamber 730) and convert the analog signals to meaningful data (e.g., presence of smoke, concentration of particulate matter, etc.). Data collector 914 is configured to collect (e.g., aggregate, obtain, sort, compile, etc.) any data received via communications interface 908 from any of the sensors, devices, systems, etc., of fire safety device 700, according to some embodiments. In some embodiments, data collector 914 provides the collected data to mode selection manager 910.

Referring still to FIG. 9, memory 906 is shown to include mode selection manager 910. In some embodiments, mode selection manager 910 is configured to receive any of the collected data from data collector 914 and determine a mode of operation of controller 726 and fire safety device 700. In some embodiments, mode selection manager 910 is configured to perform a fire detection algorithm to determine if controller 726 should transition into an alarm mode. In some embodiments, mode selection manager 910 is configured to select one of a normal mode, an alarm mode, and a test mode of operation of controller 726. In some embodiments, mode selection manager 910 is configured to receive a mode transition command from fire alarm control panel 112 and transition controller 726 between the various predetermined modes of operation based on the mode transition command. In some embodiments, mode selection manager 910 is configured to provide fire alarm control panel 112 with a current mode of operation of controller 726. For example, if mode selection manager 910 performs a fire detection algorithm based on the collected data and transitions controller 726 into the alarm mode of operation in response to determining that a fire has occurred in room 160, mode selection manager 910 may provide fire alarm control panel 112 with an indication that controller 726 has transitioned into the alarm mode of operation. In some embodiments, mode selection manager 910 provides fire alarm control panel 112 with any of the collected data. In some embodiments, mode selection manager 910 provides fire alarm control panel 112 with real-time data of any of the sensors, detection devices, systems, etc., of fire safety device 700.

Referring still to FIG. 9, memory 906 is shown to include a normal mode manager 916, an alarm mode manager 918, and a test mode manager 920. Memory 906 also includes a control signal generator 912, according to some embodiments. Control signal generator 912 is configured to receive one or more mode-specific operation parameters from any of normal mode manager 916, alarm mode manager 918, and test mode manager 920 and generate control signals based on the received one or more mode-specific operation parameters. In some embodiments, control signal generator 912 provides the generated control signals to any of the controllable elements (e.g., light emitting devices 704, actuator 718, alert light 706, sound device 708, etc.) to cause the controllable elements to perform operations associated with each of the one or more mode-specific operation parameters.

Normal mode manager 916 is configured to cause controller 726 and fire safety device 700 to operate according to a normal mode of operation, according to some embodiments. In some embodiments, the normal mode of operation includes periodically providing (or providing in real-time) any of the input data and/or input signals to fire alarm control panel 112. In some embodiments, normal mode manager 916 causes data collector 914 to periodically poll for information from any of the sensors, detection devices, systems, etc., of fire safety device 700. In some embodiments, when controller 726 is in the normal mode of operation, the received input data/input signals are provided to fire alarm control panel 112. In some embodiments, fire alarm control panel 112 performs a fire detection algorithm using the received data to determine if a fire is present in room 160. Fire alarm control panel 112 may provide mode selection manager 910 with an indication of whether or not a fire is present in room 160. In some embodiments, if mode selection manager 910 transitions controller 726 into a testing mode or an alarm mode based on the command received from fire alarm control panel 112.

In some embodiments, during the normal mode of operation, mode selection manager 910 is configured to perform a fire detection algorithm based on the collected data. In some embodiments, if mode selection manager 910 determines that a fire is present in room 160, mode selection manager 910 sends a command to managers 916-920 to transition into the alarm mode of operation (e.g., to cause alarm mode manager 918 to activate and provide mode-specific operation parameters to control signal generator 912). In some embodiments, mode selection manager 910 provides fire alarm control panel 112 with the results of the fire detection algorithm as well as a notification regarding the mode transition from the normal mode into the alarm mode.

Alarm mode manager 918 is configured to cause controller 726 and fire safety device 700 to operate according to an alarm mode of operation, according to some embodiments. In some embodiments, alarm mode manager 918 is used in response to determining that a fire is present in room 160. In some embodiments, alarm mode manager 918 is configured to cause controller 726 and fire safety device 700 to operate according to the alarm mode of operation. In some embodiments, the alarm mode of operation includes operating alert light 706 to provide the visual alert and operating sound device 708 to provide the visual alert. The aural alert may be a siren sound, a buzzing sound, a pulsing tone (e.g., a tone that changes in volume or frequency sinusoidally or periodically), etc., or any other sound. In some embodiments, the visual alert is a pulsating strobe light (e.g., a control signal that causes alert light(s) 706 to increase and/or decrease in intensity sinusoidally or periodically). In some embodiments, the aural alert is a noise that changes in volume or frequency sinusoidally or periodically, and the visual alert is a pulsating strobe light. In some embodiments, the changes in volume or frequency of the sound emitted by sound emitting device 708 are synchronized with the pulsing intensity of the light emitted by alert light 706. In some embodiments, control signal generator 912 receives control signals directly from fire alarm control panel 112. In some embodiments, the strobe light emitted by alert light 706 and the sound emitted by sound emitting device 708 are synchronized with other fire safety devices 700 in building 10 or in room 160. In some embodiments, the control signals received from fire alarm control panel 112 cause the light emitted by alert light 706 (e.g., the strobe light) and the sound emitted by sound emitting device 708 (e.g., the siren noise, or the sinusoidally or periodically varying frequency/volume noise) cause alert light 706 and/or sound emitting device 708 to synchronize with the light emitted by alert lights 706 and/or the sound emitted by sound emitting devices 708 of other fire safety devices 700 in building 10 or in room 160. In some embodiments, fire alarm control panel 112 provides a timing of when to start producing the sinusoidal noise and/or the strobe light such that the light emitted by alert light 706 and the sound emitted by sound emitting device 708 synchronizes with other fire safety devices 700 in building 10 or in room 160. In some embodiments, fire alarm control panel 112 provides a synchronization signal to controller 726 that alarm mode manager 918 uses to pulse the volume or pitch of the sound emitted by sound emitting device 708 and the intensity of light emitted by alert light 706.

In some embodiments, light emitting devices 704 receive a control signal from control signal generator 912 to dim some amount (e.g., the intensity of light emitted by light emitting devices 704 is reduced) during the alarm mode of operation. In some embodiments, this makes the light emitted by alert light 706 more visible and easily noticeable by occupants 150 of room 160. In some embodiments, this increases the contrast between the light emitted by alert light 706 and light emitting devices 704, thereby improving the effectiveness of the visual alert.

In some embodiments, the light emitted by alert light 706 and the sound emitted by sound emitting device 708 is at an intensity (e.g., a light intensity) and at a decibel level at or above the requirements of the National Fire Protection Association (NFPA) or any other local codes. Additionally, the light emitted by alert light 706 and the sound emitted by sound emitting device 708 is such that the pulsed light and/or the pulsed sound (e.g., sinusoidally increasing and decreasing decibel levels) meets required pulse intensity and duration requirements for fire signaling/warning. In some embodiments, alert light 706 and/or sound emitting device 708 are devices that produce visual and aural alerts in compliance with NFPA requirements.

Referring still to FIG. 9, memory 906 includes test mode manager 920, according to some embodiments. In some embodiments, test mode manager 920 is configured to cause controller 726 and fire safety device 700 to transition into a test mode of operation. In some embodiments, test mode manager 920 is configured to cause controller 726 to perform one or more testing procedures. The one or more testing procedures may include any of the smoke alarm detection test, the sound emission test, and/or the light emission test. In some embodiments, the sound emission test and the light emission test are performed concurrently and are referred to as an alarm test.

In some embodiments, the smoke detection test includes causing actuator 718 to inject a predetermined amount of smoke into the atmosphere of room 160. In some embodiments, control signal generator 912 generates and provides control signals to actuator 718 to provide the predetermined amount of smoke into room 160. In some embodiments, after or while the smoke is provided to room 160, controller 726 monitors the input data or input signals received from sensing chamber 730. In some embodiments, controller 726 operates air moving device 720 to draw the air from room 160 into sensing chamber 730 (e.g., during the smoke detection test). In some embodiments, controller 726 (or more specifically, test mode manager 920) compares the smoke detection test results to an ideal result of the smoke detection results. In some embodiments, if the smoke detection data collected over the smoke detection test does not indicate a presence of smoke, mode selection manager 910 provides a failed test result to fire alarm control panel 112. In some embodiments, if the smoke detection data collected over the smoke detection test is less than the ideal value, mode selection manager 910 and/or test mode manager 920 is configured to determine a degradation of smoke detection system 710. In some embodiments, the smoke detection test is performed periodically to track degradation of smoke detection system 710 over time. In some embodiments, fire alarm control panel 112 causes controller 726 to perform the smoke detection test periodically. In some embodiments, alert lights 706 and/or sound emitting device(s) 708 are deactivated during the smoke detection test such that the visual and aural alerts are not provided to occupants 150 during the smoke detection test. In some embodiments, fire alarm control panel 112 compares the results of a current smoke detection test to results of previously performed smoke detection tests to determine and track a degradation of smoke detection system 710 over time.

In some embodiments, test mode manager 920 is configured to cause controller 726 to perform the alarm test (e.g., on demand or in response to a user command to perform a test). In some embodiments, the alarm test includes operating alert light(s) 706 and/or sound emitting device(s) 708 to produce the visual and the aural alert. In some embodiments, test mode manager 920 receives and monitors the sound data and the light intensity data from sound sensor 732 and light sensor 716 during the alarm test. In some embodiments, if the monitored decibel level in room 160 is less than a predetermined amount (e.g., less than a decibel level as required by the NFPA), mode selection manager 910 provides fire alarm control panel 112 with an indication that sound emitting device 708 is not operating properly. In some embodiments, if the monitored decibel level of sound within room 160 is less than the predetermined amount during the alarm test, test mode manager 920 determines a difference between the decibel level of sound within room 160 during the alarm test (as measured by sound sensor 732) and the ideal decibel level. In some embodiments, test mode manager 920 determines a degradation of the sound emitting device 708 based on the difference. In some embodiments, mode selection manager 910 provides fire alarm control panel 112 with the results of the alarm test.

In some embodiments, alert light(s) 706 and/or sound emitting device(s) 708 are tested separately. In some embodiments, test mode manager 920 causes control signal generator 912 to operate alert light(s) 706 and sound emitting device(s) 708 according to the alarm test as described in greater detail hereinabove independently. The sound data and the light intensity data can be independently analyzed and used to determine if each of the alert light(s) 706 and/or sound emitting device(s) 708 are operating properly. In some embodiments, if fire safety device 700 includes multiple alert lights 706 and/or multiple sound emitting devices 708, the alarm test is performed for each of the multiple alert lights 706 and/or each of the multiple sound emitting devices 708. In some embodiments, the results of the alarm test are used to determine if each of the multiple sound emitting devices 708 and/or the multiple alert lights 706 are operating properly.

Advantageously, fire safety device 700 can perform the various testing procedures described herein above to determine proper operation of the various sensors, devices, and systems. Other fire safety devices do not provide this functionality and require manual testing to determine if they are operating properly. However, fire safety device 700 can automatically perform the tests (e.g., in response to a user input, at a variety of predetermined times, in response to a command from fire alarm control panel 112, etc.) to self-diagnose malfunctioning components. This is advantageous, since it reduces the likelihood of fire detection failure, according to some embodiments.

Another advantage of fire safety device 700 is that it combines the functionality of fire detection devices 118 as well as fire notification devices 114, according to some embodiments. This reduces the need for multiple components, provides a simpler fire system 100, and improves the aesthetic appearance of room 160 and building 10. Additionally, fire safety device 700 reduces costs associated with installing, wiring, calibrating, and testing fire detection devices 118 and fire notification devices 114. Testing fire systems manually is typically costly, obtrusive, and is only performed annually in most cases. Advantageously, fire safety device 700 can perform alarm and smoke detection tests automatically without requiring manual tests.

In some embodiments, a lighting contractor can install various power connections as well as any data connections for fire safety device 700 (e.g., power connections between fire safety device 700 and power source 729, and/or data connections between controller 726 and any of the controllable elements or any of the sensors, detection devices, systems, etc.). In some embodiments, communications interface 908 is connected (e.g., wired, communicably connected, configured to wirelessly communicate with, etc.) with fire alarm control panel 112 by a fire alarm contractor. In some embodiments, a contractor (e.g., the fire alarm contractor or the lighting contractor) installs the various power connections, the data connections, as well as the connections between communications interface 908 and fire alarm control panel 112.

In some embodiments, controller 726 provides fire alarm control panel 112 with a current power consumption of fire safety device 700. Fire alarm control panel 112 may supervise the status of power supplied to fire safety device 700. Fire alarm control panel 112 may also receive information from controller 726 regarding a condition of backup power source 727. In some embodiments, controller 726 includes a power interface (not shown) configured to receive power from power source 729 and/or backup power source 727. In some embodiments, memory 906 includes a power manager configured to read a status/condition of power provided by power source 729 and/or a condition of backup power source 727. The power manager may provide fire alarm control panel 112 with the monitored status/condition of the power provided to controller 726 from power source 729 and/or the condition of backup power source 727. Advantageously, fire alarm control panel 112 can monitor the condition of backup power source 727 and determine if backup power source 727 requires servicing or should be replaced.

Fire Safety Device Methods/Processes

Figure 10:
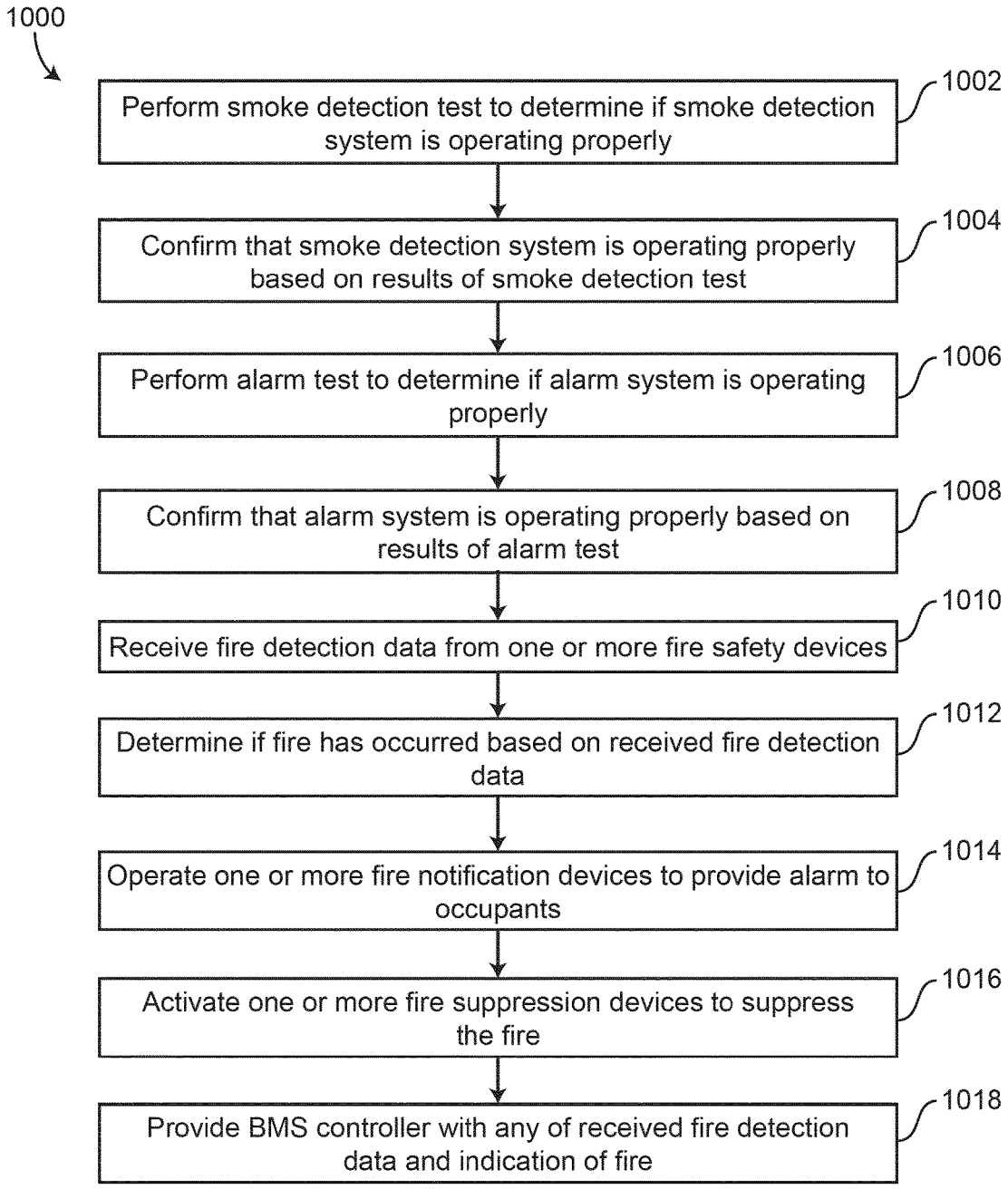
FIG. 10 is a flowchart of a process for detecting and suppressing a fire, according to some embodiments.

Referring now to FIG. 10, a process 1000 for operating a fire system is shown. Process 1000 includes steps 1002-1018, according to some embodiments. In some embodiments, process 1000 is performed by fire system 100 and one or more components or subsystems of fire system 100.

Process 1000 includes performing a smoke detection test to determine if a smoke detection system is operating properly (step 1002), according to some embodiments. In some embodiments, step 1002 includes sending a command to controller 726 of fire safety device 700 to perform the smoke detection test. In some embodiment, step 1002 includes performing process 1200. In some embodiments, step 1002 is initiated by fire alarm control panel 112 and performed by any controller 726 of various fire safety devices 700 that are communicably connected with fire alarm control panel 112. In some embodiments, the smoke detection system is one or more smoke detection systems 710 of various fire safety devices 700. In some embodiments, controller 726 (or more specifically, test mode manager 920) is configured to cause smoke emission system 712 and smoke detection system 710 to perform the smoke detection test. In some embodiments, step 1002 is performed by any fire safety devices 700 that are communicably connected with fire alarm control panel 112.

Process 1000 includes confirming that the smoke detection system is operating properly based on the results of the smoke detection test (step 1004), according to some embodiments. In some embodiments, confirming that the smoke detection system is operating properly includes comparing smoke detection test results to an expected result of the smoke detection test. For example, the expected result of the smoke detection test may be an expected ash or soot particles per million (ppm) a sample of air in room 160. In some embodiments, if the smoke detection test results are substantially the same as the expected results (e.g., the concentration of soot/ash in the sample air is substantially equal to the expected concentration of soot/ash in the sample air), process 1000 proceeds to step 1006.

Process 1000 includes performing an alarm test to determine if an alarm system is operating properly (step 1006), according to some embodiments. In some embodiments, step 1006 includes performing process 1300. In some embodiments, the alarm test is performed by any fire safety devices 700 that are communicably connected to fire alarm control panel 112. In some embodiments, the alarm test is performed by controller 726 in response to receiving a command from fire alarm control panel 112 or in response to completing the smoke detection test.

Process 1000 includes confirming that the alarm system is operating properly based on the results of the alarm test (step 1010), according to some embodiments. In some embodiments, confirming that the alarm system is operating properly based on the results of the alarm test includes comparing the results of the alarm test to expected results of the alarm test. For example, the alarm test may include emitting sound and light via sound emitting device 708 and alert light 706, respectively. The expected results of the alarm test may be sound sensor 732 and light sensor 716 measuring an expected decibel level in room 160 (e.g., the decibel level at which the sound was emitted by sound emitting device 708) and light sensor 716 measuring an expected light intensity in room 160 (e.g., the light intensity at which the light was emitted by alert light 706). In some embodiments, if the results of the alarm test match or are substantially the same as the expected alarm test results, this indicates that the alarm system is operating properly. In some embodiments, step 1008 is performed by fire alarm control panel 112. If any fire safety devices 700 that are a part of fire system 100 include multiple alert lights 706 and/or multiple sound emitting devices 708, steps 1006 and 1008 are performed multiple times for each of the alert lights 706 and sound emitting devices 708 to determine if any of the alert lights 706 and sound emitting devices 708 are not operating properly.

Process 1000 includes receiving fire detection data from one or more fire safety devices (step 1010), according to some embodiments. In some embodiments, the fire detection data includes any light intensity data, temperature data, fire detection data, sound data, etc., collected by any sensors, detection devices, systems, of one or more fire safety devices 700. In some embodiments, step 1010 is performed by fire alarm control panel 112. In some embodiments, the fire detection data is real-time data. In some embodiments, the fire detection data is received from the one or more fire safety devices 700 periodically.

Process 1000 includes determining if a fire has occurred based on the received fire detection data (step 1012), according to some embodiments. In some embodiments, step 1012 is performed by fire alarm control panel 112 based on any of the fire detection data received from the one or more fire safety devices 700. In some embodiments, step 1012 includes determining an approximate location of the fire. In some embodiments, step 1012 includes performing a fire detection algorithm with the received fire detection data to determine if a fire has occurred in building 10 or in any rooms 160 of building 10. In some embodiments, if the smoke detection data of the fire detection data indicates the presence of smoke in one or more rooms 160 of building 10, fire alarm control panel 112 determines that a fire has occurred. In some embodiments, if the smoke detection data indicates the presence of smoke in addition to elevated temperatures in one or more rooms 160 of building 10, fire alarm control panel 112 determines that a fire has occurred in building 10.

Process 1000 includes operating one or more fire safety devices to provide a fire alarm to occupants of the building (step 1014), according to some embodiments. In some embodiments, step 1014 includes operating alert lights 706 and sound emitting devices 708 of various fire safety devices 700 to provide a visual and an aural alert to occupants 150 of building 10. In some embodiments, step 1014 is performed by fire alarm control panel 112. In some embodiments, step 1014 is performed by various fire safety devices 700 of fire system 100. In some embodiments, step 1014 is performed in response to determining that a fire is present in building 10. In some embodiments, step 1014 includes performing process 1100.

Process 1000 includes activating one or more fire suppression devices to suppress the detected fire (step 1016), according to some embodiments. In some embodiments, step 1016 is performed by fire alarm control panel 112. In some embodiments, fire alarm control panel 112 is configured to activate one or more of fire suppression devices 116 in response to detecting a fire in building 10. In some embodiments, fire alarm control panel 112 is configured to activate fire suppression devices 116 that are nearest the detected fire (e.g., if the fire is detected in a particular room 160, fire alarm control panel 112 activates fire suppression devices 116 of the particular room 160).

Process 1000 includes providing a BMS controller with any of the received fire detection data and an indication of the detected fire (step 1018), according to some embodiments. In some embodiments, the BMS controller is BMS controller 366. In some embodiments, step 1018 is performed by fire alarm control panel 112. Step 1018 may include providing BMS controller 366 with any of the fire detection data received from any fire safety devices 700 of fire system 100. In some embodiments, the indication of the detected fire includes an approximate location in building 10 of the detected fire.

Figure 11:
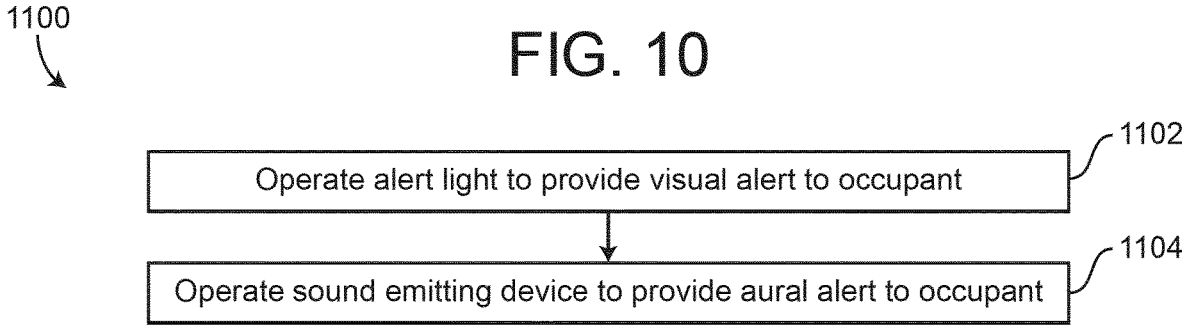
FIG. 11 is a flowchart of a process for providing a fire alarm to an occupant of a building, according to some embodiments.

Referring now to FIG. 11, a process 1000 for providing a fire alarm to occupants of a building is shown. Process 1100 includes steps 1102 and 1104, according to some embodiments. In some embodiments, process 1100 is performed by any fire safety devices 700 of fire system 100. In some embodiments, process 1100 is performed by fire safety device 700 in response to receiving a command from fire alarm control panel 112 to provide a fire alarm to occupants 150 of building 10 or of room 160. In some embodiments, process 1100 is performed by fire safety device 700 in response to detecting a fire or the presence of smoke in room 160.

Process 1100 includes operating an alert light to provide a visual alert to an occupant (step 1102), according to some embodiments. In some embodiments, the alert light is alert light 706. In some embodiments, the visual alert includes flashing, strobing, pulsing, etc., alert light 706. In some embodiments, the visual alert includes strobing alert light 706 according to a synchronization signal determined and provided by fire alarm control panel 112. In some embodiments, step 1102 is performed by alarm mode manager 918, controller 726, control signal generator 912, and alert light 706.

Process 1100 includes operating a sound emitting device to provide an aural alert to an occupant (step 1104), according to some embodiments. In some embodiments, step 1104 is performed by any of fire safety devices 700 of fire system 100. In some embodiments, the sound emitting device is sound emitting device 708. In some embodiments, step 1104 is performed concurrently with step 1102. In some embodiments, the aural alert is any of a siren noise, a buzzing noise, etc. In some embodiments, the aural alert is a noise that varies in volume or pitch over time. In some embodiments, the aural alert is provided to occupants 150 of room 160 by sound emitting device 708. In some embodiments, sound emitting device 708 provides the aural alert according to a synchronization signal received from fire alarm control panel 112.

Figure 12:
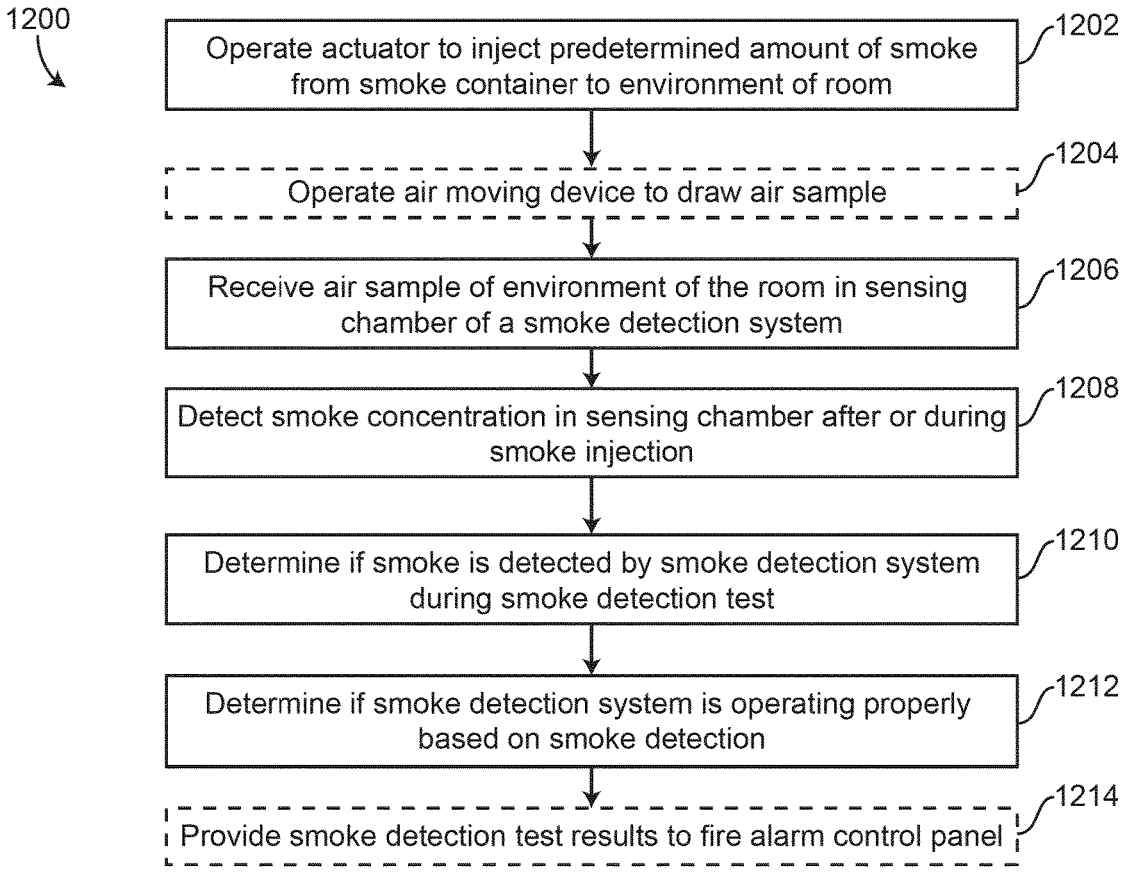
FIG. 12 is a flowchart of a process for performing a smoke detection test on a smoke detection system, according to some embodiments.

Referring now to FIG. 12, a process 1200 for performing a smoke detection test on a smoke detection system is shown. Process 1200 can be performed by any fire safety devices 700 of fire system 100. Process 1200 includes steps 1202-1214, according to some embodiments. Step 1204 may be optional, depending on the structure of fire safety device 700. In some embodiments, process 1200 is performed by controller 726, smoke detection system 710, and smoke emission system 712. Process 1200 can be performed by fire safety device 700 in response to receiving a command from fire alarm control panel 112 to perform a smoke detection test.

Process 1200 includes operating an actuator to inject a predetermined amount of smoke to an environment of a room from a smoke container (step 1202), according to some embodiments. In some embodiments, step 1202 is performed by fire safety device 700. More particularly, step 1202 may be performed by test mode manager 920. In some embodiments, the actuator is actuator 718. In some embodiments, the smoke container is smoke container 728. In some embodiments, step 1202 includes providing the predetermined amount of smoke to the room from smoke container 728 via air sample delivery system 724.

Process 1200 includes operating an air moving device to draw an air sample from the environment/atmosphere of the room (step 1204), according to some embodiments. In some embodiments, the air moving device is air moving device 720 (e.g., a fan). In some embodiments, step 1204 is performed by controller 726, or more specifically, control signal generator 912. In some embodiments, step 1204 is optional.

Process 1200 includes receiving an air sample of the environment/atmosphere of the room in a sensing chamber of a smoke detection system (step 1206), according to some embodiments. In some embodiments, the smoke detection system is smoke detection system 710. In some embodiments, the sensing chamber is sensing chamber 730. In some embodiments, step 1206 is performed by sensing chamber 730 and smoke delivery system 722.

Process 1200 includes detecting a smoke concentration (e.g., a concentration of ash, soot, etc.) of the air sample received in step 1206 (step 1208) in the sensing chamber after or during the smoke injection, according to some embodiments. In some embodiments, step 1206 is performed by sensing chamber 730 or a smoke sensor disposed within sensing chamber 730. In some embodiments, step 1208 is performed concurrently with step 1206.

Process 1200 includes determining if smoke is/was detected by the smoke detection system during the smoke detection test (step 1210), according to some embodiments. In some embodiments, step 1210 includes monitoring sensor feedback from sensing chamber 730 for a predetermined amount of time (e.g., the time duration of the smoke detection test) to determine if any smoke is detected in sensing chamber 730 over the predetermined amount of time. In some embodiments, step 1210 is performed by test mode manager 920.

Process 1200 includes determining if the smoke detection system is operating properly based on the smoke detection results received/sensed in step 1210 (step 1212), according to some embodiments. In some embodiments, step 1212 includes determining that the smoke detection system is operating properly if the detected smoke concentration is substantially equal to an expected smoke concentration. In some embodiments, step 1212 includes determining that the smoke detection system is not operating properly (e.g., is clogged) if the detected smoke concentration is less than the expected smoke concentration or if smoke is not detected by the smoke detection system over the predetermined amount of time. In some embodiments, step 1212 is performed by fire alarm control panel 112 based on smoke detection data collected from sensing chamber 730 over the smoke detection test. In some embodiments, step 1212 is performed by test mode manager 920. In some embodiments, the determination of whether or not the smoke detection system (e.g., smoke detection system 710) is operating properly are the smoke detection test results.

Process 1200 includes providing the smoke detection test results to a fire alarm control panel (step 1214), according to some embodiments. In some embodiments, the fire alarm control panel is fire alarm control panel 112. In some embodiments, step 1214 is optional and is performed if test mode manager 920 is configured to perform step 1212. In some embodiments, the smoke detection test results are provided to fire alarm control panel 112 by mode selection manager 910.

Figure 13:
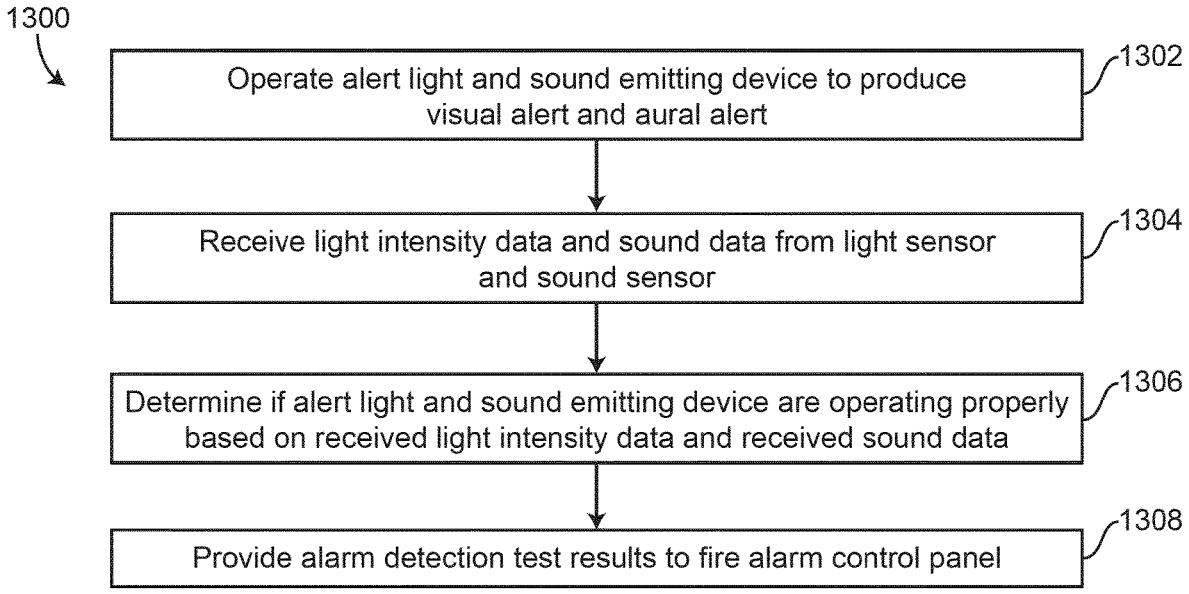
FIG. 13 is a flowchart of a process for performing an alarm test on a fire alarm system, according to some embodiments.

Referring now to FIG. 13, a process 1300 for performing an alarm test on a fire alarm system is shown. Process 1300 may be performed by any fire safety devices 700 of fire system 100. Process 1300 may be performed to determine if fire alarm functionality (e.g., alert light 706 and sound emitting device 708) of fire safety devices 700 are operating properly. Process 1300 can be performed in response to receiving a command from fire alarm control panel 112 to perform the alarm test.

Process 1300 includes operating an alert light and a sound emitting device to produce a visual alert and an aural alert (step 1302), according to some embodiments. In some embodiments, the alert light is alert light 706. In some embodiments, the sound emitting device is sound emitting device 708. In some embodiments, step 1302 is performed by controller 726.

Process 1300 includes receiving light intensity data and sound data from a light sensor and a sound sensor (step 1304), according to some embodiments. In some embodiments, the light intensity data and the sound data are collected by data collector 914 from light sensor 716 and sound sensor 732 and provided to test mode manager 920. In some embodiments, step 1304 is performed concurrently/simultaneously with step 1302.

Process 1300 includes determining if the alert light (e.g., alert light 706) and the sound emitting device (e.g., sound emitting device 708) are operating properly based on the light intensity data and the sound data received/monitored in step 1304 (step 1306), according to some embodiments. In some embodiments, step 1306 includes comparing the light intensity data and the sound data collected by data collector 914 to expected values of the light intensity data and the sound data. In some embodiments, if the collected light intensity data is not substantially equal to the expected value of the light intensity data, test mode manager 920 determines that alert light 706 is not operating properly. If the collected light intensity data is substantially equal to the excepted value of the light intensity data, test mode manager 920 determines that alert light 706 is operating properly. Test mode manager 920 can similarly compare the collected sound data to expected sound data to determine if sound emitting device 708 is operating properly.

Process 1300 includes providing alarm detection test results to fire alarm control panel 112 (step 1308), according to some embodiments. In some embodiments, the alarm detection test results include an indication of whether alert light 706 and sound emitting device 708 are operating properly (e.g., are able to produce the necessary visual and aural alerts). Step 1308 may be performed by mode selection manager 910 or test mode manager 920.

Figure 14:
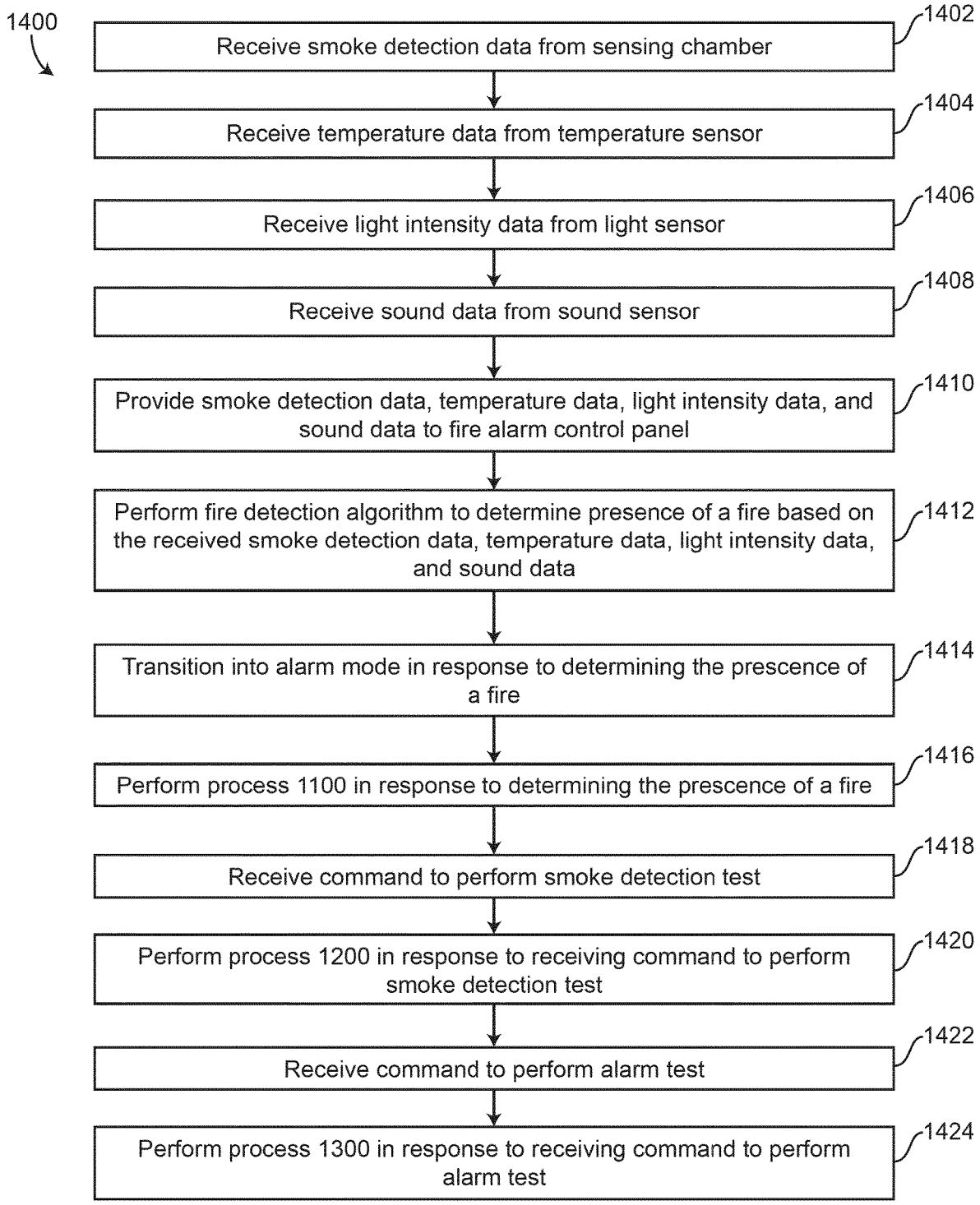
FIG. 14 is a flowchart of a process for operating the fire safety device of FIG. 5, according to some embodiments.

Referring now to FIG. 14, a process 1400 for operating fire safety device 700 is shown. Process 1400 may be performed by controller 726. Process 1400 includes steps 1402-1424, according to some embodiments. In some embodiments, process 1400 demonstrates the modes of fire safety device 700 (e.g., the normal mode of operation, the alarm mode of operation, and the test mode of operation).

Process 1400 includes receiving smoke detection data from sensing chamber 730 (step 1402), receiving temperature data from temperature sensor 714 (step 1404), receiving light intensity data from light sensor 716 (step 1406), and receiving sound data from sound sensor 732 (step 1408), according to some embodiments. In some embodiments, steps 1402-1408 are performed by data collector 914. The smoke detection data may include a concentration of particular matter (e.g., soot, ash, etc.) in an air sample. The temperature data may include a current temperature value of room 160 that can indicate a presence of fire in room 160. The light intensity data can indicate an intensity of light in room 160. The sound data can indicate a decibel level of noise in room 160.

Process 1400 includes providing the smoke detection data, the temperature data, the light intensity data, and the sound data to fire alarm control panel 112 (step 1410), according to some embodiments. In some embodiments, the smoke detection data, the temperature data, the light intensity data, and the sound data is referred to as the collected data. In some embodiments, mode selection manager 910 provides the collected data to fire alarm control panel 112 (i.e., mode selection manager 910 performs step 1410).

Process 1400 includes performing a fire detection algorithm to determine a presence of a fire in a room based on the collected data (step 1412), according to some embodiments. In some embodiments, step 1412 is performed by fire alarm control panel 112. In some embodiments, step 1412 is performed locally by controller 726 of fire safety device 700.

Process 1400 includes transitioning into the alarm mode of operation in response to determining the presence of fire in room 160 (step 1414), according to some embodiments. In some embodiments, step 1414 is performed by mode selection manager 910. Mode selection manager 910 may transition fire safety device 700 into the alarm mode of operation in response to receiving a command from fire alarm control panel 112 that a fire is present in room 160.

Process 1400 includes performing process 1100 in response to determining the presence of a fire in room 160 (step 1416), according to some embodiments. Process 1100 demonstrates the operations performed by fire safety device 700 when in the alarm mode of operation to notify occupants 150 of room 160 regarding the presence of a fire in building 10.

Process 1400 includes receiving a command to perform the smoke detection test (step 1418) and performing process 1200 in response to receiving the command to perform the smoke detection test (step 1420), according to some embodiments. In some embodiments, step 1420 is preceded by transitioning into the test mode of operation. Steps 1418 and 1420 may be performed by mode selection manager 910, and test mode manager 920, respectively. The command may be received by mode selection manager 910 from fire alarm control panel 112.

Process 1400 includes receiving a command to perform the alarm test (step 1422) and performing process 1300 in response to receiving the command to perform the alarm test (step 1424), according to some embodiments. Steps 1422 and 1424 can be performed by mode selection manager 910 and test mode manager 920, respectively.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted.

Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A device for illumination and fire safety in a room, the device comprising:

a housing;

one or more light emitting devices coupled to the housing and configured to provide ambient lighting for the room during a normal mode of operation;

an alert light configured to operate independently of the one or more light emitting devices;

one or more fire safety components coupled to the housing and configured to notify occupants of the room of a fire during an alarm mode of operation; and a controller configured to transition from the normal mode of operation into the alarm mode of operation in response to detecting the fire, operate the alert light to provide alert lighting, and operate the one or more light emitting devices to dim as the alert light operates to provide the alert lighting to increase visibility of the alert lighting during the alarm mode of operation.

2. The device of claim 1, wherein operating the alert light to provide the alert lighting and operating the one or more light emitting devices to dim as the alert light operates to provide the alert lighting comprises increasing a contrast between the alert lighting and light emitted by the one or more lighting devices to increase the visibility of the alert lighting during the alarm mode of operation.

3. The device of claim 1, wherein the one or more fire safety components comprise smoke detection system configured to detect a presence of smoke or other airborne medium in the room.

4. The device of claim 3, wherein the one or more fire safety components comprise a smoke emission system;

wherein the controller is configured to operate the smoke emission system to provide a predetermined amount of an airborne test medium to the room and monitor an amount of the airborne test medium present in an air sample detected by the smoke detection system during a test mode of operation;

wherein the housing is configured to conceal the smoke emission system and the smoke detection system from occupants of the room.

5. An illumination and fire safety system for a building, the system comprising:

a fire alarm control panel; and an illumination and fire safety device configured to provide the fire alarm control panel with fire detection data, wherein the illumination and fire safety device comprises:

one or more light emitting devices configured to provide lighting for a room;

an alert light configured to operate independently of the one or more light emitting devices;

one or more fire safety components configured to detect a presence of fire in the room;

a controller configured to receive fire detection signals from the one or more fire safety components, provide the fire detection data to the fire alarm control panel in response to detecting the presence of fire in the room, operate the alert light to provide alert lighting, and operate the one or more light emitting devices to dim as the alert light operates to provide the alert lighting to increase visibility of the alert lighting during an alarm mode of operation; and a housing configured to conceal the one or more fire safety components and the controller from occupants of the room.

6. The system of claim 5, wherein the illumination and fire safety device a sound emitting device configured to produce an aural alert regarding the presence of fire in the room, wherein the controller is configured to operate the alert light and the one or more light emitting devices to provide ambient lighting for the room during a normal mode of operation.

7. The system of claim 6, wherein the illumination and fire safety device comprises a light detector and a sound detector, wherein the controller is configured to perform an alarm test comprising:

activating at least one of the sound emitting device or the alert light; and monitoring input received via at least one of the sound detector or the light detector to determine whether the sound emitting device is producing the aural alert or the alert light is producing the visual alert.

8. The system of claim 5, wherein the one or more fire safety components comprise:

a smoke detection system configured to detect a presence of smoke or another airborne medium in the room.

9. The system of claim 8, wherein the smoke detection system comprises an air sample delivery system and a sensing chamber, wherein the air sample delivery system is configured to receive a sample of air from the room and provide the sample of air to the sensing chamber.

10. The system of claim 9, wherein the illumination and fire safety device comprises a smoke emission system configured to provide a metered amount of an airborne test medium to the room and wherein the housing is configured to conceal the smoke emission system from the occupants of the room.

11. The system of claim 10, wherein the controller is configured to perform a smoke detection test comprising operating the smoke emission system to emit the metered amount of the airborne test medium into the room, and monitoring a presence of the airborne test medium detected by the smoke detection system.

12. The system of claim 5, wherein the one or more light emitting devices are configured to provide egress lighting in an emergency.

13. A device for illumination and fire safety in a room of a building, the device comprising:

one or more light emitting devices configured to provide lighting for the room when operating in a normal mode;

a smoke detection system configured to detect a presence of smoke in the room;

a sound emitting device configured to produce an aural alert regarding a presence of fire in the room;

an alert light configured to produce a visual alert regarding the presence of fire in the room and operate independently of the one or more light emitting devices;

a controller configured to receive smoke detection information from the smoke detection system, operate the sound emitting device and the alert light to produce the aural alert and the visual alert in response to the presence of fire in the room, and operate the one or more light emitting devices to dim as the alert light operates to provide the visual alert to increase visibility of the visual alert during an alarm mode of operation; and a housing configured to conceal the smoke detection system and the controller from occupants of the room;

wherein the one or more light emitting devices are configured to illuminate the room to provide visibility for the occupants of the room when a fire is not present in the room.

14. The device of claim 13, wherein the alert light is configured to produce a strobe light for the visual alert, the sound emitting device is configured to produce a fire alarm noise for the aural alert, and the controller is configured to operate the alert light and the sound emitting device to synchronously produce the strobe light and the fire alarm noise.

15. The device of claim 13, further comprising a smoke emission system configured to provide a metered amount of airborne test medium to the room and wherein the housing is configured to conceal the smoke emission system from the occupants of the room.

16. The device of claim 15, wherein the controller is configured to perform a smoke detection test comprising operating the smoke emission system to emit the metered amount of airborne test medium into the room, and monitoring a presence of airborne test medium detected by the smoke detection system.

17. The device of claim 15, wherein the smoke emission system comprises a smoke delivery system configured to provide the metered amount of airborne test medium to the room.

18. The device of claim 13, wherein the smoke detection system comprises an air sample delivery system and a sensing chamber, wherein the air sample delivery system is configured to receive a sample of air from the room and provide the sample of air to the sensing chamber.

19. The device of claim 13, further comprising a light detector and a sound detector, wherein the controller is configured to perform an alarm test to determine if the sound emitting device is able to produce the aural alert and if the alert light is able to produce the visual alert.

20. The device of claim 19, wherein the alarm test comprises operating the alert light to produce the visual alert and monitoring intensity of light measured by the light detector to determine if the alert light is able to produce the visual alert and the alarm test comprises operating the sound emitting device to produce the aural alert and monitoring a sound level of noise in the room measured by the sound detector to determine if the sound emitting device is able to produce the aural alert.

* * * * *